US008436792B2

(12) United States Patent
Koyama

(10) Patent No.: US 8,436,792 B2
(45) Date of Patent: May 7, 2013

(54) SPONTANEOUS LIGHT EMITTING DEVICE AND DRIVING METHOD THEREOF

(75) Inventor: Jun Koyama, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 344 days.

(21) Appl. No.: 12/722,884

(22) Filed: Mar. 12, 2010

(65) Prior Publication Data

US 2010/0165012 A1 Jul. 1, 2010

Related U.S. Application Data

(62) Division of application No. 11/434,885, filed on May 17, 2006, now Pat. No. 7,696,961, and a division of application No. 09/948,091, filed on Sep. 7, 2001, now Pat. No. 7,053,874.

(30) Foreign Application Priority Data

Sep. 8, 2000 (JP) ..... 2000-273139

(51) Int. Cl.
*G09G 3/32* (2006.01)

(52) U.S. Cl.
USPC ..... 345/82; 345/690

(58) Field of Classification Search ..... 345/48, 345/82, 211, 690
See application file for complete search history.

(56) References Cited

U.S. PATENT DOCUMENTS 4,777,402 A * 10/1988 Mitsumori ..... 313/509
5,247,190 A 9/1993 Friend et al.
5,399,502 A 3/1995 Friend et al.
5,708,451 A 1/1998 Baldi
5,778,146 A 7/1998 Kawasaki et al.
6,127,991 A 10/2000 Uehara et al.
6,219,017 B1 4/2001 Shimada et al.

(Continued)

FOREIGN PATENT DOCUMENTS

EP 1225557 A 7/2002
JP 04-009996 A 1/1992

(Continued)

OTHER PUBLICATIONS

T. Shimoda, et al., "Current Status and Future of Light-Emitting Polymer Display Driven by Poly-Si TFT", Digest, May 18-20, 1999, pp. 372-375.

(Continued)

*Primary Examiner* — Yong H Sim
(74) *Attorney, Agent, or Firm* — Nixon Peabody LLP; Jeffrey L. Costellia

(57) ABSTRACT

A counter 102 counts the accumulated lighting time or the accumulated lighting time and the intensity of lighting of each pixel by a first image signal 101A and stores them in a volatile memory 103 or a nonvolatile memory 104. A correction circuit 105 corrects the first image signal based on the correction data stored previously in a correction data storage section 106 in accordance with the degree of the degradation of each spontaneous light emitting element by the use of the accumulated lighting time or the accumulated lighting time and the intensity of lighting, and produces a second mage signal 101B. By the second image signal 101B, a display unit 107 can provide a uniform screen having no variation in luminance even if the light emitting elements in a part of the pixels are degraded.

7 Claims, 16 Drawing Sheets

U.S. PATENT DOCUMENTS

| | | | | |
|---|---|---|---|---|
| 6,249,268 | B1 | 6/2001 | Tachibana et al. | |
| 6,456,337 | B1 | 9/2002 | Kobayashi et al. | |
| 6,473,065 | B1 * | 10/2002 | Fan | 345/82 |
| 6,476,783 | B2 | 11/2002 | Matthies et al. | |
| 6,498,592 | B1 | 12/2002 | Matthies | |
| 6,542,260 | B1 | 4/2003 | Gann et al. | |
| 6,583,775 | B1 | 6/2003 | Sekiya et al. | |
| 6,618,084 | B1 | 9/2003 | Rambaldi et al. | |
| 6,628,848 | B1 | 9/2003 | Nakamura | |
| 6,897,837 | B1 | 5/2005 | Sakumoto et al. | |
| 6,897,855 | B1 | 5/2005 | Matthies et al. | |
| 7,109,955 | B2 | 9/2006 | Ishizuka et al. | |
| 7,227,519 | B1 | 6/2007 | Kawase et al. | |
| 7,592,970 | B2 | 9/2009 | Matthies et al. | |
| 2002/0180721 | A1 * | 12/2002 | Kimura et al. | 345/211 |
| 2003/0063053 | A1 | 4/2003 | Yamazaki et al. | |
| 2003/0071804 | A1 | 4/2003 | Yamazaki et al. | |
| 2008/0174515 | A1 | 7/2008 | Matthies et al. | |

FOREIGN PATENT DOCUMENTS

| | | | |
|---|---|---|---|
| JP | 10-254410 | A | 9/1998 |
| JP | 11-015437 | A | 1/1999 |
| JP | 11-109918 | A | 4/1999 |
| JP | 11-305722 | | 11/1999 |
| JP | 2001-056670 | A | 2/2001 |
| JP | 2001-350442 | A | 12/2001 |
| JP | 2002-006796 | A | 1/2002 |
| WO | WO-99/41732 | A | 8/1999 |
| WO | WO-99/41787 | A | 8/1999 |
| WO | WO-99/41788 | | 8/1999 |
| WO | WO-02/047310 | A | 6/2002 |

OTHER PUBLICATIONS

T. Shimoda, et al., "High Resolution Light Emitting Polymer Display Driven by Low Temperature Polysilicon Thin Film Transistor with Integrated Driver", Asia Display 98, pp. 217-220.

Chang Wook Han, et al., "3.8 □ Green OLED with low Temperature poly Si TFT", EuroDisplay '99 Late-news papers, Sep. 6-9, 1999, pp. 27-30.

* cited by examiner

SPONTANEOUS LIGHT EMITTING DEVICE AND DRIVING METHOD THEREOF

BACKGROUND OF THE INVENTION

1. Field of the Invention

The present invention relates to a spontaneous light emitting device, in particular, an active matrix type spontaneous light emitting device. Further, in particular, the present invention relates to an active matrix type spontaneous light emitting device using a spontaneous light emitting element including an organic electroluminescence (EL) element for a pixel portion. The EL (electroluminescent) devices referred to in this specification include triplet-based light emission devices and/or singlet-based light emission devices, for example.

2. Description of the Related Art

In recent years, an active matrix type spontaneous light emitting device using a spontaneous light emitting device in which a semiconductor thin film is formed on an insulating body such as a glass substrate or the like, in particular, TFT has remarkably come into wide use. The active matrix type spontaneous light emitting device using the TFTs has hundreds of thousands to millions of TFTs in the pixel portion arranged in a matrix and displays an image by controlling the charges of the respective pixels.

A technology relating to a polysilicon TFT for forming a driving circuit at the same time by using a TFT around a pixel portion in addition to a pixel TFT constituting an pixel has been developed as a recent technology and contributes to the miniaturization and low power consumption of the device and hence the spontaneous light emitting device becomes an indispensable device for the display unit of a mobile gear which has been remarkably expanded in the application in recent years.

The spontaneous light emitting device utilizing a spontaneous light emitting material such as an organic EL and the like has received widespread attention as a flat display substituting for a LCD (liquid crystal display) and has been actively researched.

In FIG. 15A is schematically shown a conventional spontaneous light emitting device. In the present specification, an organic EL (hereinafter simply referred to as "EL") will be described as an example of a spontaneous light emitting device. A pixel portion 1504 is arranged in the center of a substrate 1501 made of an insulating material (for example, glass). In the pixel portion 1504 are arranged electric current supply lines 1505 for supplying an electric current to EL elements in addition to source signal lines and gate signal lines. On the upper side of the pixel portion 1504 is arranged a source signal line driving circuit 1502 for controlling the source signal lines, and on the right and left sides are arranged gate signal driving circuits 1503 for controlling the gate signal lines. In this connection, in FIG. 15A, the gate signal line driving circuits 1503 are arranged on both the right and left sides of the pixel portion but the gate signal line driving circuit 1503 may be arranged only on one side. However, it is desirable from the viewpoint of driving efficiency and reliability that the gate signal line driving circuits 1503 are arranged on both sides. Signals are applied to the source signal line driving circuit 1502 and the gate signal driving circuits 1503 from the outside via a flexible printed circuit board (FCP) 1506.

An enlarged view of a portion surrounded by a dotted line 1500 in FIG. 15A is shown in FIG. 15B. In the pixel portion, as shown in this figure, respective pixels are arranged in a matrix. Further, in FIG. 15B, a portion surrounded by a dotted line 1510 is one pixel and includes a source signal line 1511, a gate signal line 1512, an electric current supply line 1513, a switching TFT 1514, an TFT 1515 for driving an EL element, a holding capacitance 1516, and an EL element 1517.

Next, the action of the active matrix type spontaneous light emitting device will be described with reference to FIG. 15B. First, when the gate signal line 1512 is selected, a voltage is applied to the gate electrode of the switching TFT 1514 to bring the switching TFT 1514 into conduction and then the signal (voltage) of the source signal line 1511 is accumulated in the holding capacitance 1516. Since the voltage of the holding capacitance 1516 becomes the voltage $V_{GS}$ between the gate and source of the TFT 1515 for driving an EL element, an electric current responsive to the voltage of the holding capacitance 1516 flows through the TFT 1515 for driving an EL element and the EL element 1517. As a result, the EL element 1517 emits light.

The luminance of the EL element 1517, that is, the amount of electric current flowing through the EL element 1517 can be controlled by the $V_{GS}$ of the TFT 1515 for driving an EL element. The $V_{GS}$ is the voltage of the holding capacitance 1516 and the signal (voltage) applied to the source signal line 1511. In other words, by controlling the signal (voltage) applied to the source signal line 1511, the luminance of the EL element is controlled. Finally, the gate signal line 1512 is brought out of a selected state and the gate of the switching TFT 1514 is closed to bring the switching TFT 1514 out of conduction. At that time, the charges accumulated in the holding capacitance 1516 are held. Therefore, the $V_{GS}$ of the TFT 1515 for driving an EL element is held as it is and an electric current corresponding to the $V_{GS}$ continues to flow through the EL element 1517 via the TFT 1515 for driving an EL element.

As to driving the EL element, results of researches are reported in SID99, page 372, "Current Status and Future of Light-Emitting Polymer Display Driven by Poly-Si TFT"; ASIA DISPLAY 98, page 217, "High Resolution Light Emitting Polymer Display Driven by Low Temperature Polysilicon Thin Film Transistor with Integrated Driver"; and Euro Display 99 Late News, page 27, "3.8 Green OLED with Low Temperature Poly-Si TFT".

Next, the mode of the gradation display of the EL element 1517 will be described. An analog gradation mode in which the luminance of the EL element 1517 is controlled by the voltage $V_{GS}$ between the gate and source of the TFT 1515 for driving an EL element, as described above, has a drawback that the luminance of the EL element 1517 is susceptible to variations in current characteristics of the TFT 1515 for driving an EL element. In other words, when the current characteristics of the TFT 1515 for driving an EL element are changed, even if the same gate voltage is applied thereto, the value of the electric current flowing through the TFT 1515 for driving an EL element and the EL element 1517 is changed. As a result, this changes the luminance, that is, the gradation of the EL element 1517.

Hence, in order to reduce variations in characteristics of the TFT 1515 for driving an EL element and to obtain a uniform screen, a mode called a digital gradation mode has been invented. This mode is the one in which the gradation is controlled by two states of the absolute value of voltage $|V_{GS}|$ between the gate and source of the TFT 1515 for driving an EL element: one state in which the voltage $|V_{GS}|$ is smaller than a voltage for starting emitting light (the electric current hardly flows) and another state in which the voltage $|V_{GS}|$ is larger than a luminance saturating voltage (nearly maximum electric current flows). In this case, if the voltage $|V_{GS}|$ is made sufficiently larger than the luminance saturating voltage, even if the current characteristics of the TFT 1515 for driving an EL element are varied, the value of electric current comes near to $I_{MAX}$. Therefore, this can extremely reduce the effect of the variations in the current characteristics of the TFT 1515 for driving an EL element. Since the gradation is controlled by the two states of an ON state (in which the screen is bright because the maximum electric current flows) and an OFF state (in which the screen is dark because the electric current does not flow), as described above, this mode is called a digital gradation mode.

However, in the case of the digital gradation mode, only two gradations can be displayed in this state. Hence, a plurality of technologies have been proposed in which another mode is combined with the digital gradation mode technology to make a multiple-step gradation.

Among the multiple-step gradation modes is a time-gradation mode. The time-gradation mode is the one in which the gradation is produced by changing time during which an EL element 817 emits light: in other words, one frame period is divided into a plurality sub-frame periods and the number or the length of the sub-frame periods during which the EL element 817 emits light is controlled to display gradations.

See FIG. 9. FIG. 9 simply shows a timing chart of a time-gradation mode. This is an example in which a frame frequency is 60 Hz and in which three-bit gradation is produced by the time-gradation mode.

As shown in FIG. 9A, one frame period is divided into sub-frames periods of the number of bits displaying the gradation. Here, since the number of bits displaying the gradation is three, the one frame period is divided into three sub-frame periods $SF_1$, $SF_2$, and $SF_3$. The one sub frame period is further divided into an address period ($Ta_{\#}$) and sustaining (lighting) period ($Ts_{\#}$). The sustaining period in the $SF_1$ is called $Ts_1$. Similarly, the sustaining periods in the $SF_2$ and $SF_3$ are called $Ts_2$ and $Ts_3$. The address periods $Ta_1$ to $Ta_3$ are equal to each other in the respective sub-frame periods because the address period is a time during which an image signal of one frame is written. Here, the sustaining periods are determined at a ratio of the n-th power of 2, like $Ts1:Ts_2:Ts_3=2^2:2^1:2^0=4:2:1$. However, even if the ratio of length of the sustaining period is not a ratio of the n-th power of 2, as described above, the gradation can be expressed.

The gradation is displayed by a method of controlling illuminance by changing the total time in which the EL element emits light in one frame period by controlling the EL element in a state where it emits light or in a state in which it does not emit light in the sustaining (lighting) period from $Ts_1$ to $Ts_3$. In this example, as shown in FIG. 9B, the length of light emitting time can be determined in 8 ways ($=2^3$), depending on the combinations of light emitting sustaining (lighting) periods, and hence the 8 levels of gradation from 0 (complete black display) to 7 (complete white display) can be displayed. In the time-gradation mode, the gradation can be displayed in this manner. Needless to say, the gradation can be displayed in the same manner also in an spontaneous light emitting device for a color display.

In the case where the number of levels of gradation needs to be increased, it is recommended that the number of divisions in one frame period be increased. In the case where one frame period is divided into n sub-frame periods, the ratio of the lengths of sustaining (lighting) periods becomes like $Ts_1:Ts_2:Ts_3:\ldots:Ts_{(n-1)}:Ts_n=2^{(n-1)}:2^{(n-2)}:\ldots:2^1:2^0$, and hence the $2^n$ levels of gradation can be displayed. In this connection, as to the order of the sub-frame periods, $SF_1$ to $SF_n$, may appear at random.

Here, problems relating to the spontaneous light emitting device using the spontaneous light emitting element such as an EL element or the like will be described. As described above, while the EL element emits light, the electric current is always supplied to the EL element and hence flows therethrough. Therefore, if the EL element emits light for a long time, the EL element is degraded in its quality, which causes a change in luminance characteristics. In other words, even if an EL element which is degraded and an EL element which is not degraded are supplied with the same voltage from the same power source, they are different form each other in luminance.

Describing a specific example, FIG. 10A is a display screen of a personal digital assistant or the like using a spontaneous light emitting device and displays icons for operation 1001 and the like. Usually, in the use of such a device, the ratio of a still picture display as shown in FIG. 10A is large. At that time, if the icons and the like are displayed in brighter color (gradation) than the background, the EL elements in the pixels in the portion where the icons are displayed emit light for a longer time than the EL elements displaying the background and hence are rapidly degraded.

Assuming that the degradation of the EL elements proceeds under such conditions, display examples of the spontaneous light emitting device after degradation are shown in FIG. 10B, C. First, in the case of a black display shown in FIG. 10B, the spontaneous light emitting element including the EL element displays black in the state where a voltage is not applied to the element and thus does not present a problem of degradation when it displays black. In the case of a white display, even if the EL element which is degraded because it emits light for a long time (in this case, the EL element in the portion where the icons and the like are displayed) is supplied with the same current, it can not produce sufficient luminance but produces variations in luminance, as shown by a reference numeral 1011 in FIG. 10C.

Among methods of eliminating variations in luminance is a method of increasing a voltage applied to the degraded EL element. However, conventionally, an electric current supply line is a single wiring in the spontaneous light emitting device and it is not easy to constitute in a pixel portion a circuit for changing a voltage applied to the EL element in a specific pixel of the pixels arranged in a matrix. Further, because the EL driving TFT has variations, as described above, such a correction method is not desirable.

Further, in the spontaneous light emitting device for a color display, the EL elements for displaying red, green, blue are sometimes different from each other in the degrees of luminance and degradation. Although some methods for correcting the variations in luminance caused by these reasons have been proposed, even the pixels of the same color sometimes produce variations in the degree of degradation and luminance and in this case, the above-mentioned methods can not solve these variations.

As another method for solving the problem is also thought a method of using an EL element having characteristics capable of emitting light for a long time, but the life of the EL element in the current state of art is not sufficient. Therefore, the object of the present invention is to provide a spontaneous light emitting device capable of displaying a normal image having no variations in luminance, even if the elements in the screen are degraded.

SUMMARY OF THE INVENTION

In order to solve the above-mentioned problems, the present invention provides the following means.

In a spontaneous light emitting device having a degradation correction function in accordance with the present invention, the lighting time or the lighting time and the intensity of lighting of each pixel are detected by periodically sampling an image signal and the accumulated values thereof are compared with the data of time-varying luminance characteristics of an EL element stored in advance to correct the image signal for driving the pixel having a degraded EL element every time the image signal is sampled, whereby a uniform screen having no variations in luminance can be kept even in the spontaneous light emitting device in which a part of pixels have the degraded EL elements.

The constitution of a spontaneous light emitting device in accordance with the present invention will be described in the following.

A spontaneous light emitting device is a device to which an image signal is inputted to display an image and is characterized in that the device includes:

a unit for detecting the accumulated lighting time of each pixel;

a unit for storing the accumulated lighting time; and a unit for correcting the image signal according to the stored accumulated lighting time, wherein the image is displayed by the use of the corrected image signal.

A spontaneous light emitting device is a device to which an image signal is inputted to display an image and is characterized in that the device includes:

a unit for detecting the accumulated lighting time and the intensity of lighting of each pixel;

a unit for storing the accumulated lighting time and the intensity of lighting; and a unit for correcting the image signal according to the accumulated lighting time and the intensity of lighting, which are stored, wherein the image is displayed by the use of the corrected image signal.

A spontaneous light emitting device is a device to which an image signal is inputted to display an image and is characterized in that the device includes:

a degradation correction unit including:

a counter section for sampling a first image signal and periodically detecting the lighting time of a spontaneous light emitting element of each pixel;

a memory circuit for accumulating and storing the lighting time of the spontaneous light emitting element of each pixel, which is detected by the counter section; and a signal correction section for correcting the first image signal according to the accumulated lighting time of the spontaneous light emitting element of each pixel, which is accumulated and stored in the memory circuit, and for outputting a second image signal; and a display unit for displaying the image by the second image signal.

A spontaneous light emitting device is a device to which an image signal is inputted to display an image and is characterized in that the device includes:

a degradation correction unit including:

a counter section for sampling a first image signal and periodically detecting the lighting time and the intensity of lighting of a spontaneous light emitting element of each pixel;

a memory circuit for accumulating and storing the lighting time and the intensity of lighting of the spontaneous light emitting element of each pixel, which are detected by the counter section; and a signal correction section for correcting the first image signal according to the accumulated lighting time and the intensity of lighting of the spontaneous light emitting element of each pixel, which are accumulated and stored in the memory circuit, and for outputting a second image signal; and a display unit for displaying the image by the second image signal.

A spontaneous light emitting device is a device for displaying an n-bit gradation (n: natural number, $n \geqq 2$) further comprises a driving circuit for performing an (n+m)-bit signal processing (m: natural number), and wherein the image signal written in the pixel having a spontaneous light emitting element which is not degraded displays the gradation by an n-bit image signal, and wherein a correction of gradation is made, by the use of an m-bit image signal, to the image signal written in the pixel having an spontaneous light emitting element which is degraded, whereby the luminance of the spontaneous light emitting element which is not degraded is made equal to that of the spontaneous light emitting element which is degraded.

A spontaneous light emitting device is a device, wherein a correction of addition relative to the image signal written in the pixel having the spontaneous light emitting element which is not degraded is made to the image signal written in the pixel having the spontaneous light emitting element which is degraded.

A spontaneous light emitting device is a device, wherein a correction of subtraction relative to the image signal written in the pixel having the spontaneous light emitting element which is most degraded is made to the image signal written in the pixel having the spontaneous light emitting element which is a little degraded or the pixel having the spontaneous light emitting element which is not degraded.

A spontaneous light emitting device is a device as, wherein the memory unit or the memory circuit is a static type memory circuit (SRAM).

A spontaneous light emitting device is a device, wherein the memory unit or the memory circuit is a dynamic type memory circuit (DRAM).

A spontaneous light emitting device is a device, wherein the memory unit or the memory circuit is a ferroelectric memory circuit (FeRAM).

A spontaneous light emitting device is a device, wherein the memory unit or the memory circuit is an electrically erasable programmable read-only, nonvolatile memory (EEPROM).

A spontaneous light emitting device is a device, wherein the detection unit, the memory unit, and the correction unit are constituted by the external circuits of the spontaneous light emitting device.

A spontaneous light emitting device is a device, wherein the detection unit, the memory unit, and the correction unit are formed on the same insulator as the spontaneous light emitting device.

A spontaneous light emitting device is a device, wherein the counter section, the memory unit, and the signal correction section are constituted by the external circuits of the spontaneous light emitting device.

A spontaneous light emitting device is a device, wherein the counter section, the memory unit, and the signal correction section are formed on the same insulator as the spontaneous light emitting device.

A spontaneous light emitting device is an EL display.

A spontaneous light emitting device is a PDP display.

A spontaneous light emitting device is a FED display.

A method for driving a spontaneous light emitting device is a method to which an image signal is inputted to display an image and is characterized in that the method includes the steps of:

sampling a first image signal and periodically detecting, by a counter section, the lighting time of a spontaneous light emitting element of each pixel;

accumulating and storing, by a memory circuit, the lighting time of the spontaneous light emitting element of each pixel, which is detected by the counter section; and correcting the first image signal and outputting a second image signal, by a signal correction section, according to the accumulated lighting time of the spontaneous light emitting element of each pixel, which is accumulated and stored by the memory circuit; and displaying the image by the second image signal.

A method for driving a spontaneous light emitting device is a method to which an image signal is inputted to display an image and is characterized in that the method includes the steps of:

sampling a first image signal and periodically-detecting, by a counter section, the lighting time and the intensity of lighting of a spontaneous light emitting element of each pixel;

accumulating and storing, by a memory circuit, the lighting time and the intensity of lighting of the spontaneous light emitting element of each pixel, which are detected by the counter section; and correcting the first image signal and outputting a second image signal, by a signal correction section, according to the accumulated lighting time and the intensity of lighting of the spontaneous light emitting element of each pixel, which are accumulated and stored in the memory circuit; and displaying the image by the second image signal.

A method for driving a spontaneous light emitting device is a method for displaying an n-bit gradation (n: natural number, $n \geqq 2$) further comprises a driving circuit for performing an (n+m)-bit signal processing (m: natural number), and wherein the image signal written in the pixel having a spontaneous light emitting element which is not degraded displays the gradation by an n-bit image signal, and wherein a gradation correction is made to the image signal written in the pixel having an spontaneous light emitting element which is degraded by an m-bit signal, whereby the luminance of the spontaneous light emitting element which is not degraded is made equal to that of the spontaneous light emitting element which is degraded.

A method for driving a spontaneous light emitting device is a method wherein a correction of addition relative to the image signal written in the pixel having the spontaneous light emitting element which is not degraded is made to the image signal written in the pixel having the spontaneous light emitting element which is degraded.

A method for driving a spontaneous light emitting device is a method wherein a correction of subtraction relative to the image signal written in the pixel having the spontaneous light emitting element which is most degraded is made to the image signal written in the pixel having the spontaneous light emitting element which is little degraded or the pixel having the spontaneous light emitting element which is not degraded.

BRIEF DESCRIPTION OF THE DRAWINGS

Preferred embodiments of the present invention will be described in detail based on the following figures, in which.

DESCRIPTION OF THE PREFERRED EMBODIMENTS

Figure 1:
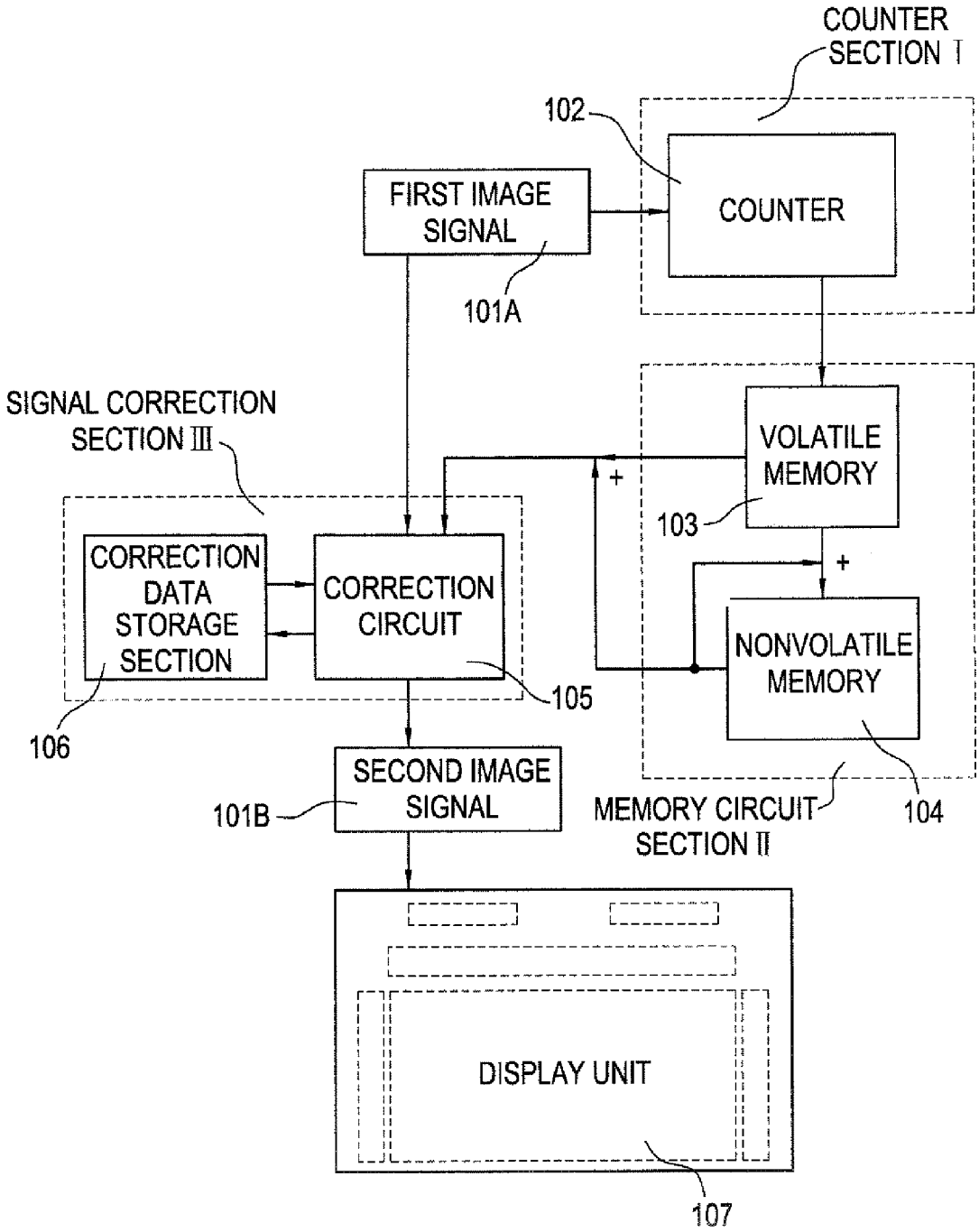
FIG. 1 is a block diagram of a spontaneous light emitting device having a degradation correction function in accordance with the present invention.

Referring now to FIG. 1, FIG. 1 is a block diagram of a spontaneous light emitting device having a degradation correction function in accordance with the present invention. The degradation correction device, which is the essential part of the present invention, includes a counter section I, a memory circuit section II, and a signal correction section III. The counter section I has counter 102, and the memory circuit section II has a volatile memory 103, and a nonvolatile memory 104, and the signal correction section III has a correction circuit 105 and a correction data storage section 106.

Figure 14A:
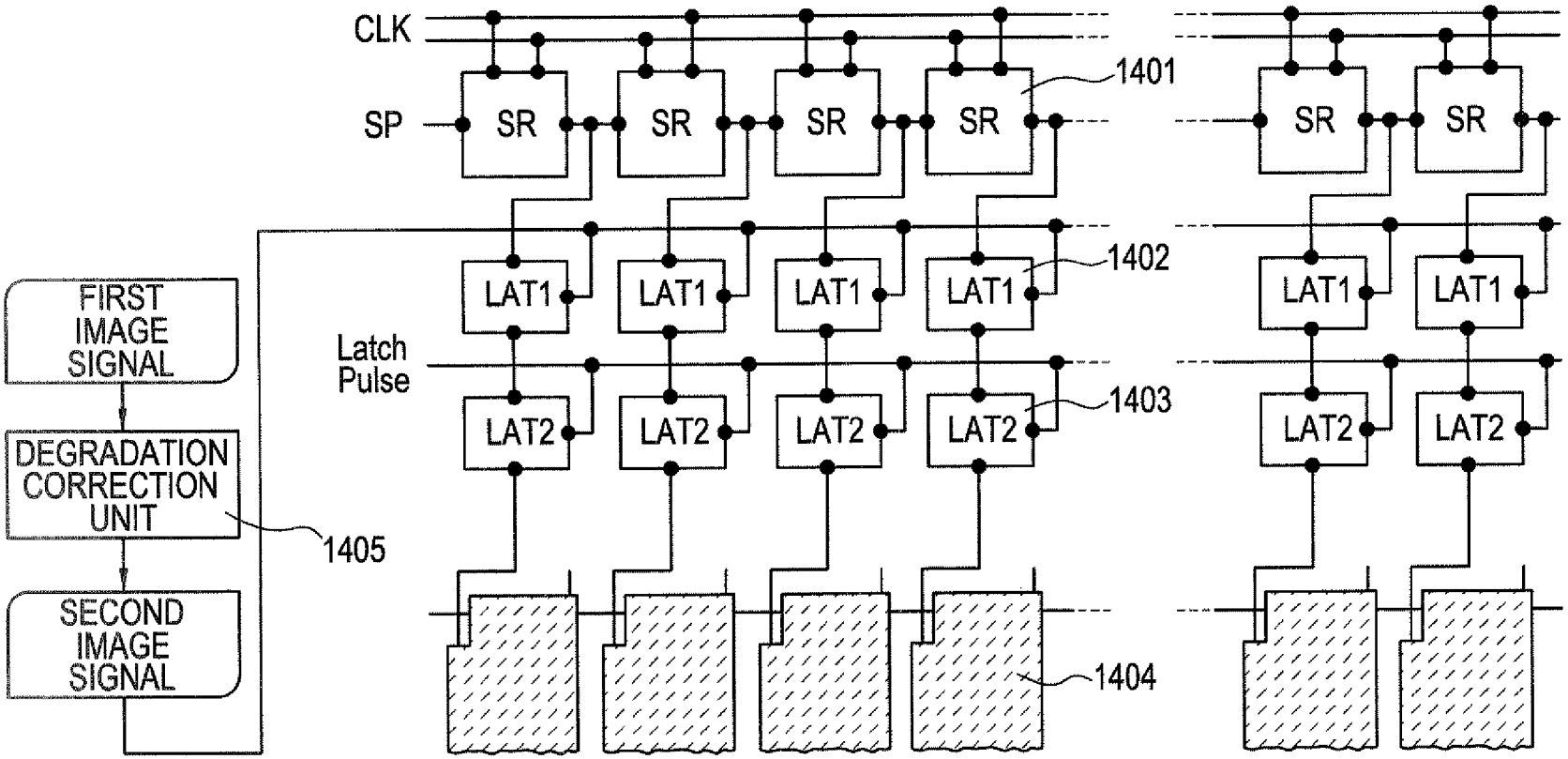
FIGS. 14A and 14B are block diagrams of a source signal line driving circuit of a digital image signal input type and an analog signal input type in a spontaneous light emitting device having a degradation correction function in accordance with the present invention.

The circuit diagram of a source signal line driving circuit in a display unit 107 is shown in FIG. 14A. Here, this is a display unit responsive to a digital image signal. The source signal line driving circuit has a shift register (SR) 1401, a first latch circuit (LAT1) 1402, and a second latch circuit (LAT2) 1403. A reference numeral 1404 designates a pixel and a reference numeral 1405 designates the degradation correction unit shown in FIG. 1.

The actions of the respective sections will be described. According to a clock signal (CLK) and a start pulse (SP), sampling pulses are outputted in sequence from the shift register. The first latch circuit holds the digital image signal according to the timing from the sampling pulse. As shown in FIG. 14A, the correction of the image signal is already finished at this timing and the image signal becomes a second image signal. When the image signal is held for one horizontal period in the first latch circuit, a latch pulse is outputted and the digital image signal is transferred to the second latch circuit. Then, the second latch circuit writes in the pixel. At the same time, according to the sampling pulse from the shift register, the first latch circuit again holds the digital image signal.

Next, the action of the whole degradation correction unit will be described. First, data of time-varying luminance characteristics of the EL element used in the spontaneous light emitting device is previously stored in the correction data storage section 106. This data is used mainly as a map when the signal is corrected according to the degree of the degradation of the EL element of each pixel.

Next, a first image signal 101A is sampled periodically (for example, every one second) and the counter 102 counts lightings or non-lightings of the respective pixels according to the sampled signals. Here, the number of lightings of the respective pixels is stored one by one in the memory circuit section. Here, since the number of lightings is accumulated, it is desirable that the memory circuit is constituted by a nonvolatile memory. However, since the nonvolatile memory generally has a limited number of writings, as shown in FIG. 1, it is also recommended that the number of lightings be stored in the volatile memory 103 while the spontaneous light emitting device is operated and be written in the nonvolatile memory 104 periodically (for, example, every one hour, or when power source is shut down).

Further, in the case where the gradation display using the EL element is conducted also by controlling luminance, it is recommended that the intensity of lighting of the EL element at that time be detected together and that the state of degradation of the EL element be judged from the lighting time and the intensity of lighting. In this case, the data for correction is also made in accordance with them.

Further, while the memories used for the memory circuit include a static type memory (SRAM), a dynamic type memory (DRAM), a ferroelectric memory (FeRAM), an EEPROM, and a flash memory, the present invention does not limit the kind of memory to a specific one but the memory generally used can be used. However, in the case where a DRAM is used as a volatile memory, it is necessary to add a function of periodically refreshing the memory.

Next, the correction operation of the image signal will be described. Referring again to FIG. 1, the first image signal 101A and the data of the accumulated lighting time or the accumulated lighting time and the intensity of lighting of each pixel are inputted to the correction circuit 105. The correction circuit 105 refers to a map for image signal correction, which is previously stored in the correction data storage section, and the accumulated lighting time or the accumulated lighting time and the intensity of lighting of each pixel and corrects the inputted image signal in accordance with the degree of degradation of each pixel. The second image signal 101E corrected in this way is inputted to the display unit 107 to display the image.

When the power source is shut down, the accumulated lighting time or the accumulated lighting time and the intensity of lighting of the EL element of each pixel, which are stored in the volatile memory circuit, is added to the accumulated lighting time or the accumulated lighting time and the intensity of lighting of the EL element of each pixel, which are stored in the nonvolatile memory circuit and is stored therein. In this manner, after the power source is turned on next time, the lighting time or the lighting time and the intensity of lighting of the EL element is continuously accumulated and counted.

Since the lighting time of the EL element is periodically detected and the accumulated lighting time or the accumulated lighting time and the intensity of lighting of the EL element is stored in this manner, by referring to the previously stored data of time-varying luminance characteristics of the EL element, it is possible to periodically correct the image signal and to correct the image signal of the degraded EL element so as to achieve the luminance equivalent to the luminance of the not-degraded EL element. Therefore, it is possible to keep the uniform screen with no variations in luminance.

Further, since the correction method used in the spontaneous light emitting device in accordance with the present invention eliminates the need for user's operation, the correction operation can continuously be made after the device is delivered to an end user, whereby the life of the device is expected to be elongated.

While an example using the EL element as the spontaneous light emitting device has been described above, the spontaneous light emitting device in accordance with the present invention is not limited to the EL element but the other spontaneous light emitting device such as a PDP and a FED may be used.

PREFERRED EMBODIMENTS

The preferred embodiments in accordance with the present invention will be described in the following.

Embodiment 1

In the present preferred embodiment, the correction method of a digital image signal in a signal correction section will be described.

Chief among the methods of correcting the luminance of the degraded EL element by a signal level is a method in which a certain correction value is added to an inputted digital image signal to convert the signal into a signal which produces substantially larger than the original signal by several levels of gradation to achieve a luminance equivalent to the luminance before degradation. In order to realize this in the simplest circuit design, it is recommended that a circuit capable of producing levels of gradation to be added be prepared in advance. To be more specific, for example, in the case of a 6-bit digital gradation (64-level gradation) spontaneous light emitting device having a degradation correction function in accordance with the present invention, one bit for correction is added to the device to design and make the device substantially have 7-bit digital gradation (128-level gradation). In the ordinary operation are used 6 lower order bits and when the EL element is degraded, a correction value is added to the normal digital image signal and the added signal is operated by the use of the added one bit. In this case, the most significant bit (MSB) is used only for signal correction and the actual gradation is displayed by the use of 6 bits.

Further, in the case of using a higher order bit for correction, one bit of the highest order is not necessarily used. In other words, in the case where the normal gradation is displayed by 6 bits, even a driving circuit having a capacity of 8 bits or more is used, the operation is formed in the same way.

Embodiment 2

In the present embodiment, the correction method of the digital image signal different from the embodiment 1 will be described.

Figure 2A:
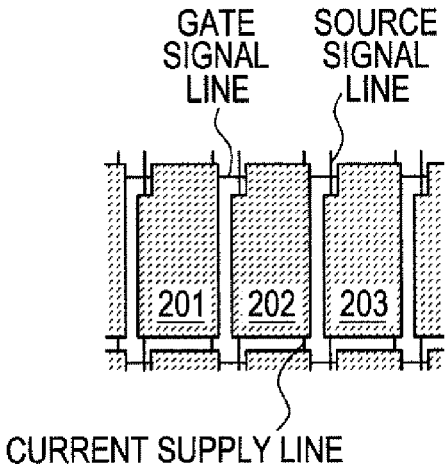
FIGS. 2A to 2E are views to show a correction method by an addition processing.
Figure 2B:
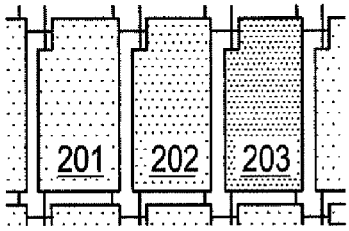
Figure 2C:
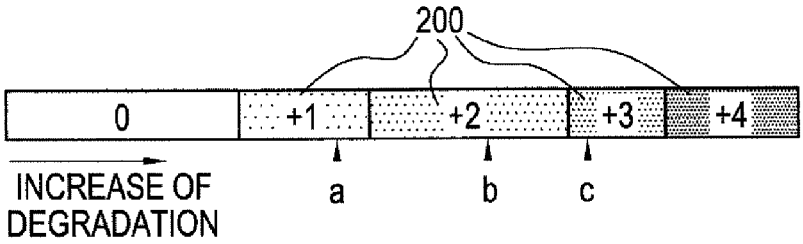

Referring now to FIG. 1 and FIG. 2, FIG. 2A shows a part of the pixel of the display unit 107 in FIG. 1. Here, referring to three pixels 201 to 203, assume that the pixel 201 is not degraded and both of the pixels 202 and 203 are degraded to certain degrees, respectively. If the degree of degradation of the pixel 203 is larger than that of the pixel 202, a reduction in luminance of the pixel 203 is naturally made larger by the degradation than that of the pixel 202. In other words, if a certain halftone is displayed, as shown in FIG. 2B, variations in luminance occur: the luminance of the pixel 202 is lower than that of the pixel 201 and the luminance of the pixel 203 is further lower than that of the pixel 202.

Next, an actual correction operation will be described. The relationship between the lighting time or the lighting time and the intensity of lighting of the EL element and a reduction in luminance caused by the degradation is measured in advance, and a map in which the correction amounts corresponding to the accumulated lighting time is set is prepared and stored in the correction data storage section 106. One example will be shown in FIG. 2C. A numeral in a block designated by a reference numeral 200 means the correction amount of the digital image signal. That is, one is always added to the digital image signal inputted to the pixel in which the degradation of the EL element is accumulated to a level (a) to transform the original signal to a signal which is brighter than the original signal by one level of gradation. Similarly, a correction of two levels of gradation is made to the signal in the level (b), and a correction of three levels of gradation is made to the signal in the level (c). A reduction in luminance caused by the degradation is not always proportional to the accumulated lighting time or the accumulated lighting time and the intensity of lighting and hence a correction range of the image signal is approximated by a step of one level of gradation.

Figure 2D:
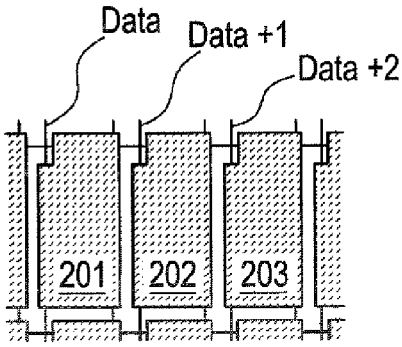
Figure 2E:
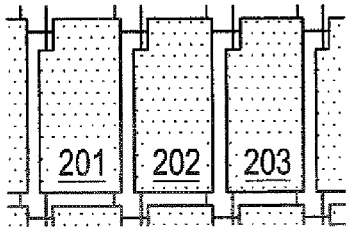

In FIG. 1, the digital image signal (the first image signal) 101A is inputted to the correction circuit 105 and the correction circuit 105 reads out the accumulated lighting time of each pixel stored in the memory circuit section. The accumulated lighting time or the accumulated lighting time and the intensity of lighting of each pixel, which is/are read out from the memory circuit section, is compared with to the above-mentioned map for correction to determine the correction value of each digital image signal. Describing the operation specifically with reference to FIG. 2A, the pixel 201 is judged to be not degraded from the accumulated lighting time or the accumulating time and the intensity of lighting and hence a correction is not made to the image signal. When the pixel 202 is judged to be degraded to a level (a) in FIG. 2B, as shown in FIG. 2D, a correction of adding one level of gradation is made to the digital image signal lighting the pixel 202. Similarly, when the pixel 203 is judged to be degraded to a level (b), a correction of adding two levels of gradation is made to the digital image signal lighting the pixel 203. In this manner, the correction of adding the gradation can provide a screen having a uniform luminance shown in FIG. 2E.

Next, a correction method of subtracting gradation will be described. Referring to FIG. 1 and FIGS. 3A to 3D, FIGS. 3A to 3C are similar to FIGS. 2A to 2C and hence descriptions thereof will be omitted.

Figure 3A:
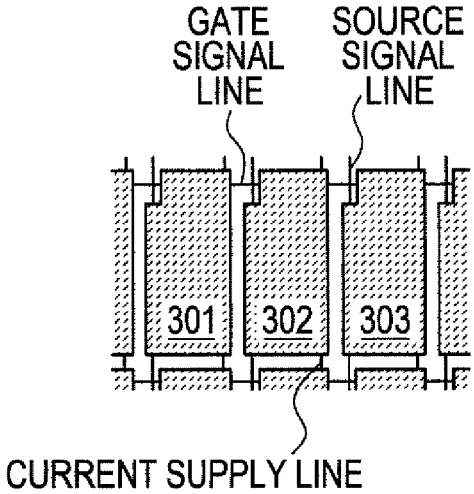
FIGS. 3A to 3E are views to show a correction method by a subtraction processing.
Figure 3B:
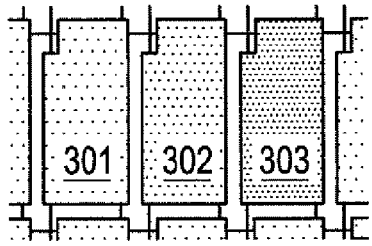
Figure 3C:
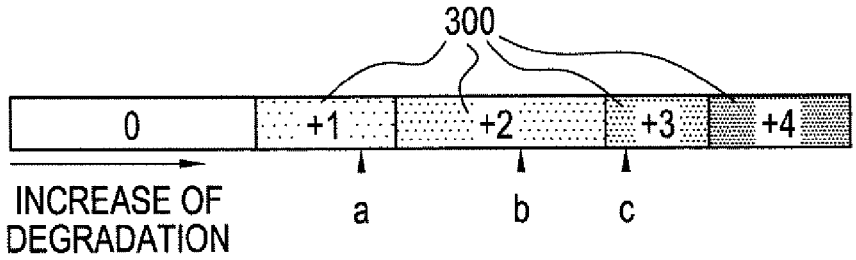
Figure 3D:
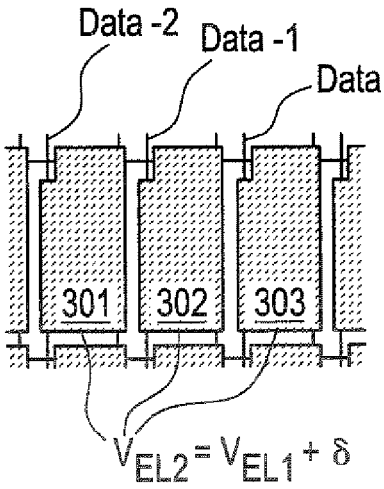
Figure 3E:
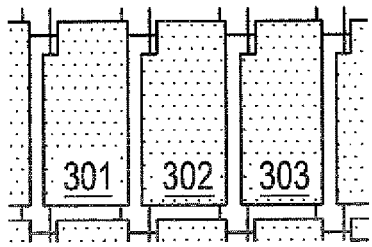

The accumulated lighting time or the accumulated lighting time and the intensity of lighting of each pixel is compared with the map shown in FIG. 3C in which correction amounts are set to determine the correction value of each digital image signal. Here, a reference pixel, that is, a pixel, to which no correction is made and an original digital image signal is inputted as it is, is the one which is judged to be most degraded from the accumulated lighting time or the accumulated lighting time and the intensity of lighting. To be more specific, the pixel 303 in FIG. 3B fits in the reference pixel. The digital image signal inputted to the other pixel is corrected according to the degree of degradation with respect to the pixel 303. As shown in FIG. 3D, an original digital image signal is inputted to the pixel 303 which is most degraded (be graded to a level (b), in FIG. 3C), and a digital image signal to which a correction of a (−1) level of gradation is made is inputted to the pixel 302 which is less degraded than the pixel 303 by one step (be graded to a level (a), in FIG. 3C), and a digital image signal to which a correction of a (−2) levels of gradation is made is inputted to the pixel 301 which is judged to be not degraded from the accumulated lighting time or the accumulated lighting time and the intensity of lighting.

However, if the corrections are made by the above-mentioned operations, the luminance of the whole screen is reduced by several levels of gradation (the difference between the gradation by the original digital image signal and the gradation by the second image signal written in the pixel whose EL element is not degraded). Therefore, as shown in FIG. 3D, the voltage $V_{EL}$ across both electrodes of the EL elements is slightly raised by changing the potential of a current supply line ($V_{EL1}+\delta \rightarrow V_{EL2}$), whereby the luminance of the whole screen is complemented.

The former correction of adding the gradation has a disadvantage that the variations in luminance can be corrected only by correcting the digital image signal but that a correction can not be made to a white display (specifically, for example, in the case where "111111" is inputted as a 6-bit digital image signal, the correction of adding the gradation can not be made further). Further, the latter correction of subtracting the gradation is characterized in that the potential control of the current supply line to complement the luminance is added but that, contrary to the correction of adding the gradation, the range in which the correction can not be made is the one of a black display and hence has little effect on the display (to be specific, for example, in the case where "000000" is inputted as a 6-bit digital image signal, the correction of subtracting the gradation is not required and a correct black display can be made in the normal EL element and the degraded EL element (it is essential only that the EL element is set in the non-lighting state). Further, several levels of gradation near the black display become almost insignificant if the number of corresponding bits of the display unit is considerably large). Both of the correction methods are advantageous for increasing the number of levels of gradation.

Further, for example, making proper use of both methods of the correction of adding the gradation and the correction of subtracting the gradation according to whether or not the level of gradation is larger than a certain level of gradation is effective for complementing the disadvantages of both the methods.

Embodiment 3

In the spontaneous light emitting device having the degradation correction function in accordance with the present invention, in the preferred embodiment (FIG. 1), the degradation correction unit is disposed outside the display unit 107 and the digital image signal (the first image signal) 101A is first inputted to the correction circuit 105 and is immediately corrected and the corrected digital image signal (the second image signal) 101B is inputted to the display unit 107 via the FPC. The advantage of this method includes that the degradation correction unit is compatible with the other units because the degradation correction unit is a single unit (the conventional spontaneous light emitting device is also used as the display unit 107 as it is). On the other hand, if the degradation correction unit and the display unit are integrally formed on the same substrate, the number of parts can be largely reduced to realize a reduction in cost and space and high speed driving.

Figure 4A:
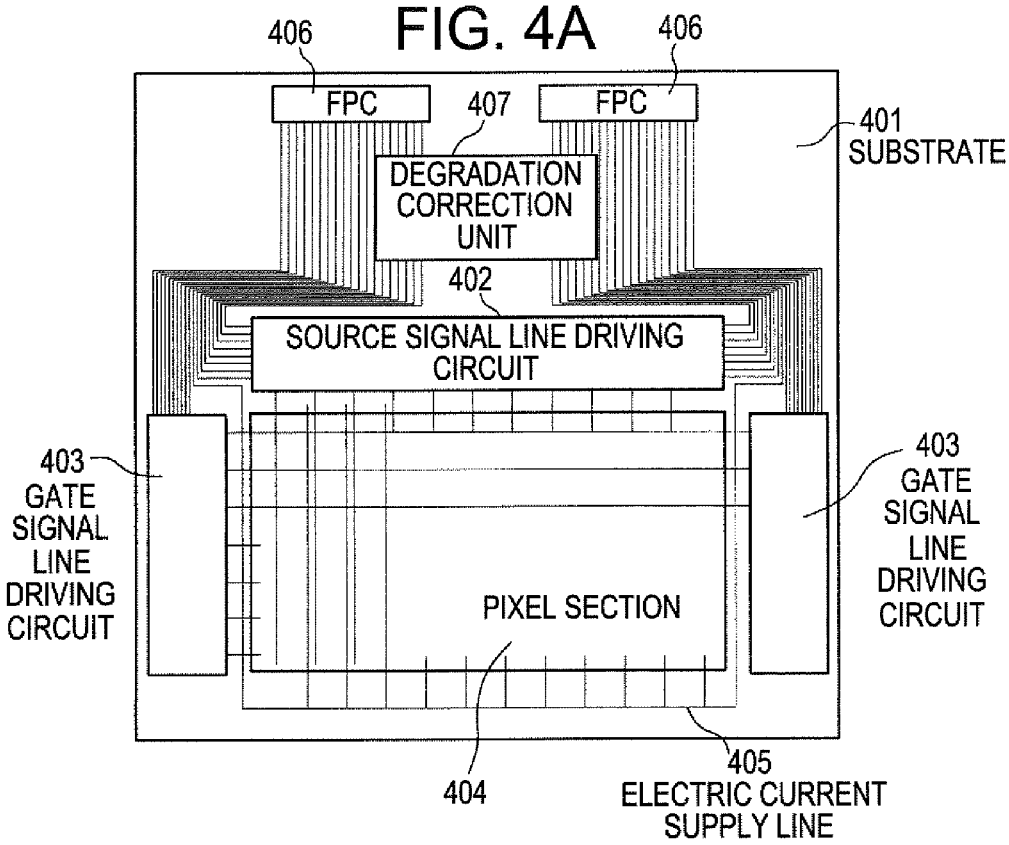
FIG. 4A shows an example in which a degradation correction unit and a display unit are integrally formed on the same substrate.
Figure 4B:
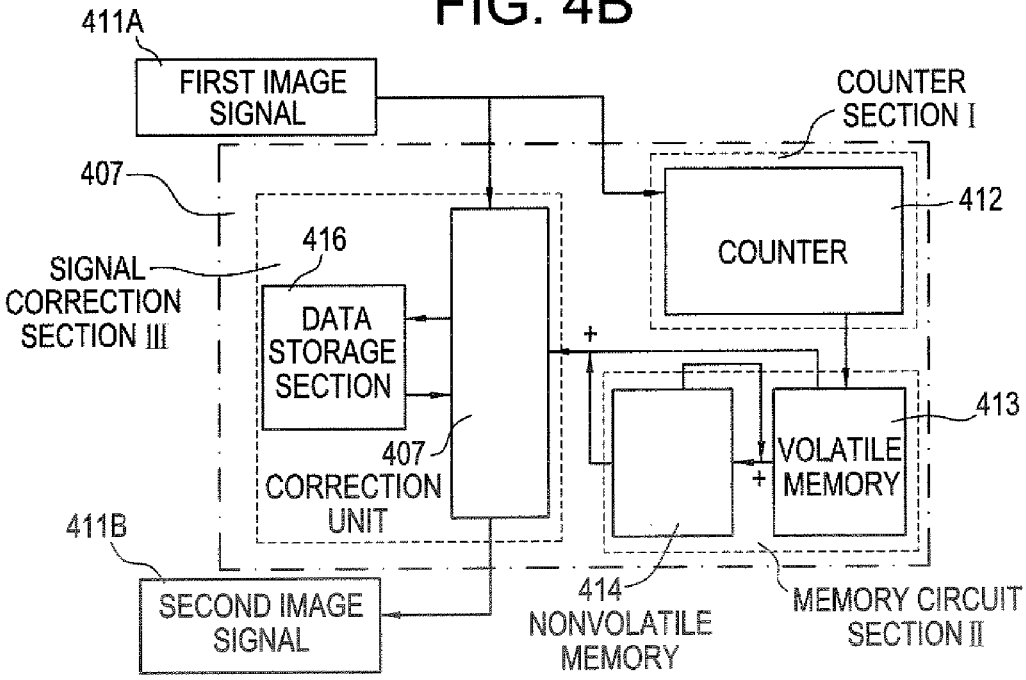
FIG. 4B is a block diagram to show one example of a spontaneous light emitting device in the case where a display unit and a signal correction unit are integrally formed on the same substrate.

In the spontaneous light emitting device having the degradation correction function in accordance with the present invention, an embodiment is shown in FIG. 4A in which the degradation correction unit and the display unit are integrally formed on the same substrate. A display unit having a source signal line driving circuit 402, a gate signal line driving circuit 403, a pixel section 404, an electric current supply line 405, and an FPC 406, and a degradation correction unit 407 are integrally formed on a substrate 401. FIG. 4B is one example of an internal block diagram of the degradation correction unit 407 in FIG. 4A. Of course, the layout on the substrate is not confined to the example shown in the drawing, but it is desirable that the blocks are disposed adjacently to each other, taking into account the arrangement of the signal lines, lengths of wirings and the like.

A digital image signal (the first image signal) 411A is inputted to a correction circuit 415 in the degradation correction unit 407 via the FPC 406 from an external image source. Thereafter, a corrected digital image signal the second image signal) 4118 which is corrected by the methods shown in the preferred embodiment and embodiments 1 and 2 is inputted to a source signal line driving circuit 402.

In this connection, although not shown in FIG. 4, it is essential only that a necessary control signal be inputted to the degradation correction unit. In the embodiment shown in FIG. 4A, the degradation correction unit 407 is disposed between the FPC 406 and the source signal line driving circuit 402 and hence the control signal can be easily taken out.

Embodiment 4

Figure 13:
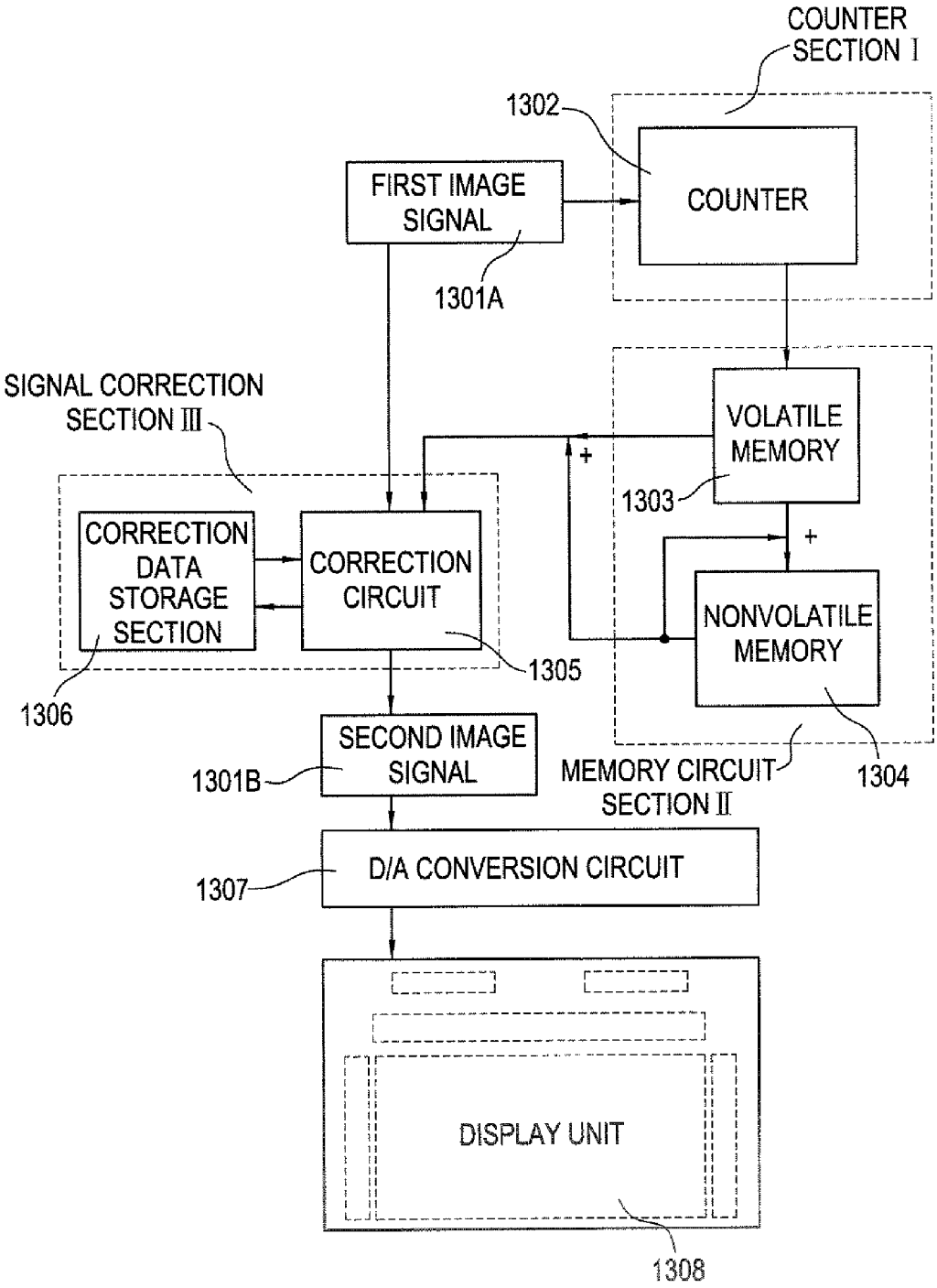
FIG. 13 is a block diagram of a spontaneous light emitting device having a degradation correction function in accordance with the present invention.

Referring now to FIG. 13, a spontaneous light emitting device having a degradation correction function in accordance with the present invention can be easily applied to a display unit responsive to an analog image signal. In such a case, a second image signal (digital image signal) outputted from a degradation correction unit including a counter section I, a memory circuit section II, and a signal correction section III is converted into an analog image signal by a D/A conversion circuit 1307 and is inputted to a display unit 1308 responsive to the analog image signal to display an image.

Figure 14B:
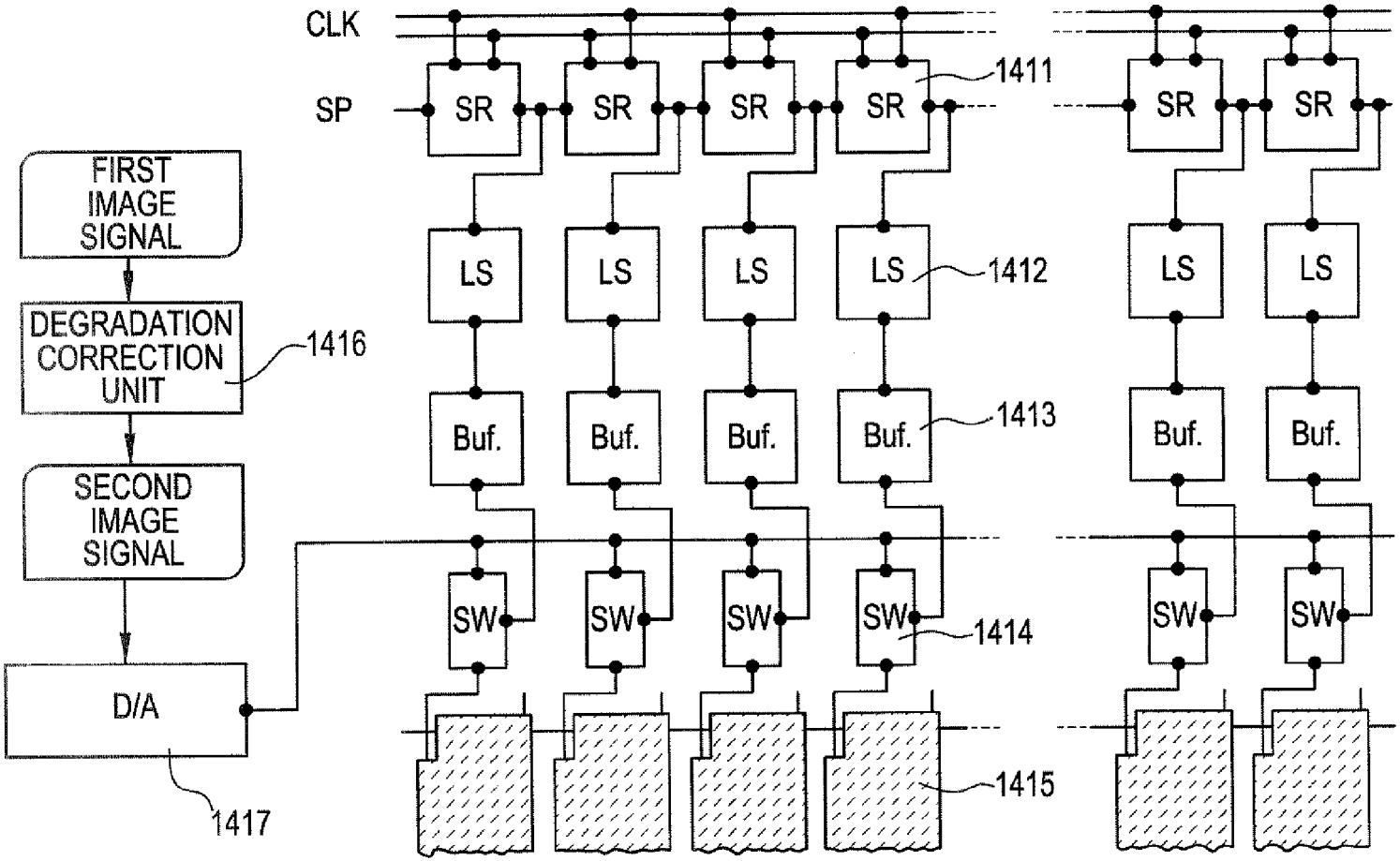
Figure 15A:
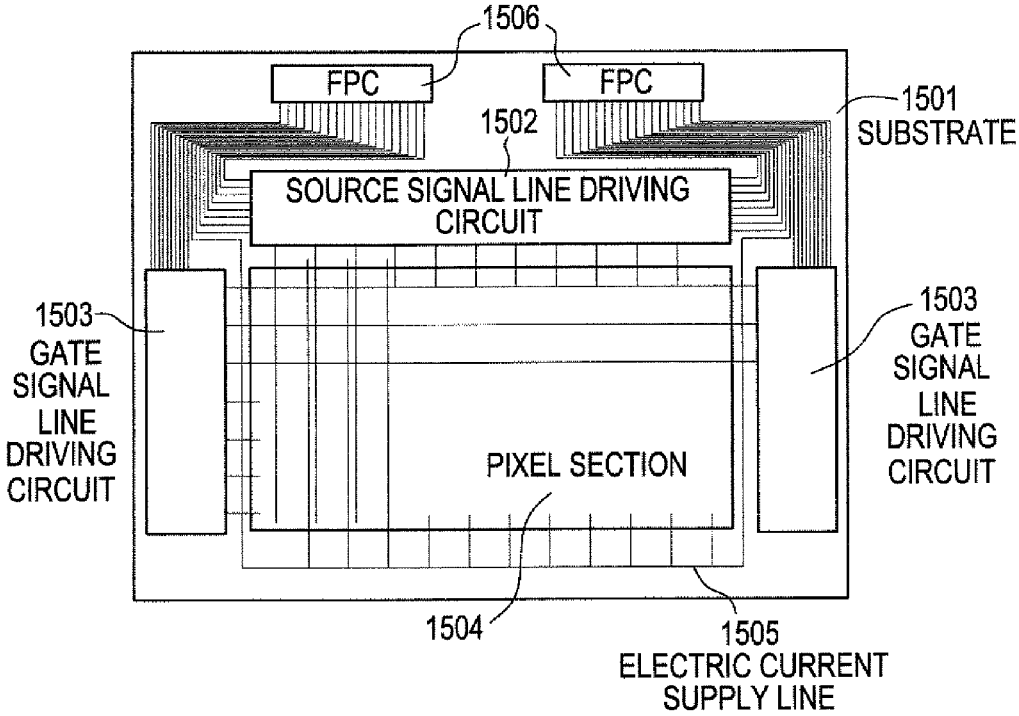
FIGS. 15A and 15B are views to show one example of a conventional spontaneous light emitting device.
Figure 15B:
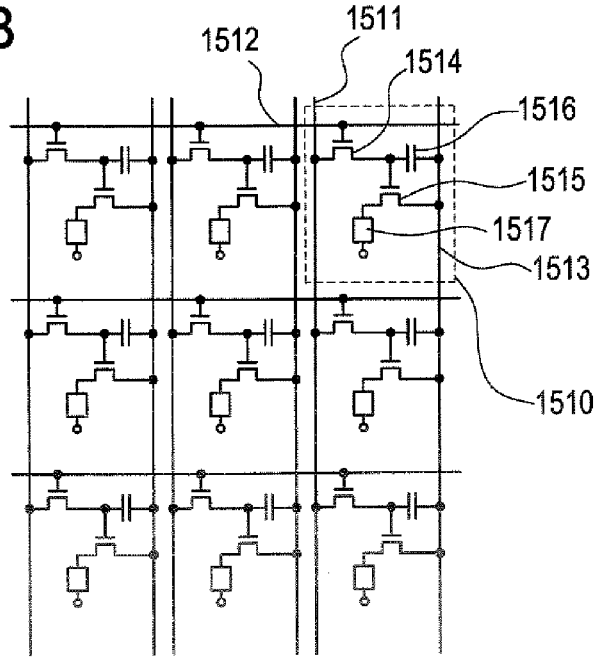

The circuit diagram of a source signal line driving circuit in a display unit 1308 shown in FIG. 13 is shown in FIG. 14B. Here, this is a display unit responsive to an analog image signal. The source signal line driving circuit has a shift register (SR) 1411, a level shifter 1412, a buffer 1413, a sampling switch 1414 and the like. A reference numeral 1415 designates a pixel, a reference numeral 1416 designates the degradation correction unit shown in FIG. 13, and a reference numeral 1417 designates a D/A conversion circuit.

The actions of the respective sections will be described. According to a clock signal (CLK) and a start pulse (SP), sampling pulses are outputted in sequence from the shift register. Then, the voltage amplitude of the pulse is enlarged by the level shifter and is outputted via the buffer. A digital image signal is corrected by the degradation correction unit and is converted into an analog image signal by the D/A conversion circuit and is inputted to a video signal line. Thereafter, according to the timing of the sampling pulse, the sampling switch is opened and the analog image signal inputted to the video signal line is sampled and voltage information is written into a pixel. In this manner, an image is displayed.

In the embodiment shown in FIG. 13, the degradation correction unit is disposed outside the display unit, but as described in the embodiment 3, these units may be integrally formed on the same substrate.

Embodiment 5

In Embodiment 5, a method of manufacturing TFTs of a pixel portion, a driver circuit portion (source signal line driver circuit, gate signal line, driver circuit and pixel selection signal line driver circuit) formed in the periphery thereof in an active EL display device of the present invention simultaneously and a nonvolatile storage circuit at the same time is explained. Note that a CMOS circuit which is a base unit is illustrated as the driver circuit portion to make a brief explanation.

Figure 5A:
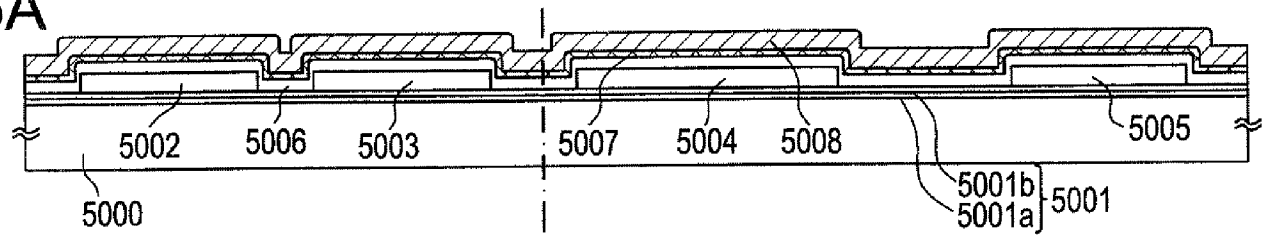
FIGS. 5A to 5C are views to show a manufacturing process example of an active matrix type spontaneous light emitting device.

First, as shown in FIG. 5A, a substrate 5000 is used, which is made of glass such as barium borosilicate glass or alumino borosilicate glass, typified by #7059 glass or #1737 glass of Corning Inc. There is no limitation on the substrate 5000 as long as a substrate having a light transmitting property is used, and a quartz substrate may also be used. In addition, a plastic substrate having heat resistance to a treatment temperature of this embodiment may also be used.

Then, a base film 5001 formed of an insulating film such as a silicon oxide film, a silicon nitride film or a silicon oxide nitride film is formed on the substrate 5000. In this embodiment, a two-layer structure is used for the base film 5001. However, a single layer film or a lamination structure consisting of two or more layers of the insulating film may also be used. As a first layer of the base film 5001, a silicon oxide nitride film 5001*a* is formed with a thickness of 10 to 200 nm (preferably 50 to 100 nm) using $SiH_4$, $NH_3$, and $N_2O$ as reaction gases by a plasma CVD method. In this embodiment, the silicon oxide nitride film 5001*a* (composition ratio Si=32%, O=27%, N=24% and H=17%) having a film thickness of 50 nm is formed. Then, as a second layer of the base film 5001, a silicon oxide nitride film 5001*b* is formed so as to be laminated on the first layer with a thickness of 50 to 200 nm (preferably 100 to 150 nm) using $SiH_4$ and $N_2O$ as reaction gases by the plasma CVD method. In this embodiment, the silicon oxide nitride film 5001*b* (composition ratio Si=32%, O=59%, N=7% and H=2%) having a film thickness of 100 nm is formed.

Subsequently, semiconductor layers 5002 to 5005 are formed on the base film. The semiconductor layers 5002 to 5005 are formed such that a semiconductor film having an amorphous structure is formed by a known method (a sputtering method, an LPCVD method, a plasma CVD method or the like), and is subjected to a known crystallization process (a laser crystallization method, a thermal crystallization method, a thermal crystallization method using a catalyst such as nickel, or the like) to obtain a crystalline semiconductor film, and the crystalline semiconductor film is patterned into desired shapes. The semiconductor layers 5002 to 5005 are formed with a thickness of 25 to 80 nm (preferably 30 to 60 nm). The material of the crystalline semiconductor film is not particularly limited, but it is preferable to form the film using silicon, a silicon germanium ($Si_xGe_{1-x}$ (X=0.0001 to 0.02)) alloy, or the like. In this embodiment, an amorphous silicon film of 55 nm thickness is formed by a plasma CVD method, and then, a nickel-containing solution is held on the amorphous silicon film. A dehydrogenation process of the amorphous silicon film is performed (at 500° C. for 1 hour), and thereafter a thermal crystallization process is performed (at 550° C. for 4 hours) thereto. Further, to improve the crystallinity, a laser annealing process is performed to form the crystalline silicon film. Then, this crystalline silicon film is subjected to a patterning process using a photolithography method to obtain the semiconductor layers 5002 to 5005.

Further, after the formation of the semiconductor layers 5002 to 5005, a minute amount of impurity element (boron or phosphorus) may be doped to control a threshold value of the TFT.

Besides, in the case where the crystalline semiconductor film is manufactured by the laser crystallization method, a pulse oscillation type or continuous emission type excimer laser, YAG laser, or $YVO_4$ laser may be used. In the case where those lasers are used, it is appropriate to use a method in which laser light radiated from a laser oscillator is condensed into a linear shape by an optical system, and is irradiated to the semiconductor film. Although the conditions of crystallization should be properly selected by an operator, in the case where the excimer laser is used, a pulse oscillation frequency is set to 30 Hz, and a laser energy density is et to 100 to 400 $mJ/cm^2$ (typically 200 to 300 $mJ/cm^2$). In the case where the YAG laser is used, it is appropriate to set a pulse oscillation frequency as 1 to 10 Hz using the second harmonic, and to set a laser energy density to 300 to 600 $mJ/cm^2$ (typically, 350 to 500 $mJ/cm^2$). Then, laser light condensed into a linear shape with a width of 100 to 1000 μm, for example, 400 μm, is irradiated to the whole surface of the substrate, and an overlapping ratio (overlap ratio) of the linear laser light at this time may be set to 50 to 90%.

A gate insulating film 5006 is then formed for covering the semiconductor layers 5002 to 5005. The gate insulating film 5006 is formed of an insulating film containing silicon with a thickness of 40 to 150 nm by a plasma CVD or sputtering method. In this embodiment, the gate insulating film 5006 is formed of a silicon oxide nitride film with a thickness of 110 nm by the plasma CVD method (composition ratio Si=32%, O=59%, N=7%, and H=2%). Of course, the gate insulating film is not limited to the silicon oxide nitride film, and other insulating films containing silicon may be used with a single layer or a lamination structure.

Besides, when a silicon oxide film is used, it can be formed such that TEDS (tetraethyl orthosilicate) and $O_2$ are mixed by the plasma CVD method with a reaction pressure of 40 Pa and a substrate temperature of 300 to 400° C., and discharged at a high frequency (13.56 MHz) power density of 0.5 to 0.8 $W/cm^2$. The silicon oxide film thus manufactured can obtain satisfactory characteristics as the gate insulating film by subsequent thermal annealing at 400 to 500° C.

Then, a first conductive film 5007 of 20 to 100 nm thickness and a second conductive film 5008 of 100 to 400 nm thickness are formed into lamination on the gate insulating film 5006. In this embodiment, the first conductive film 5007 made of a TaN film with a thickness of 30 nm and the second conductive film 5008 made of a W film with a thickness of 370 nm are formed into lamination. The TaN film is formed by sputtering with a Ta target under a nitrogen containing atmosphere. Besides, the W film is formed by sputtering with a W target. The W film may also be formed by a thermal CVD method using tungsten hexafluoride ($WF_6$). Whichever method is used, it is necessary to make the material have low resistance for use as a gate electrode, and it is preferred that the resistivity of the W film is set to 20 μΩcm or less. It is possible to make the W film have low resistance by making the crystal grains large. However, in the case where many impurity elements such as oxygen are contained within the W film, crystallization is inhibited and the resistance becomes higher. Therefore, in this embodiment, the W film is formed by sputtering using a W target having a high purity of 99.9999%, and also by taking sufficient consideration so as to prevent impurities within the gas phase from mixing therein during the film formation, and thus, a resistivity of 9 to 20 μΩcm can be realized.

Note that, in this embodiment, the first conductive film 3007 is made of TaN, and the second conductive film 5008 is made of W, but the material is not particularly limited thereto, and either film may be formed from an element selected from the group consisting of Ta, W, Ti, Mo, Al, Cu, Cr, and Nd or an alloy material or a compound material containing the above element as its main constituent. Besides, a semiconductor film typified by a polycrystalline silicon film doped with an impurity element such as phosphorus may be used. An alloy made of Ag, Pd, and Cu may also be used. Further, any combination may be employed such as a combination in which the first conductive film is formed of a tantalum (Ta) film and the second conductive film is formed of a W film, a combination in which the first conductive film is formed of a titanium nitride (TiN) film and the second conductive film is formed of a W film, a combination in which the first conductive film is formed of a tantalum nitride (TaN) film and the second conductive film is formed of an Al film, or a combination in which the first conductive film is formed of a tantalum nitride (TaN) film and the second conductive film is formed of a Cu film.

Figure 5B:
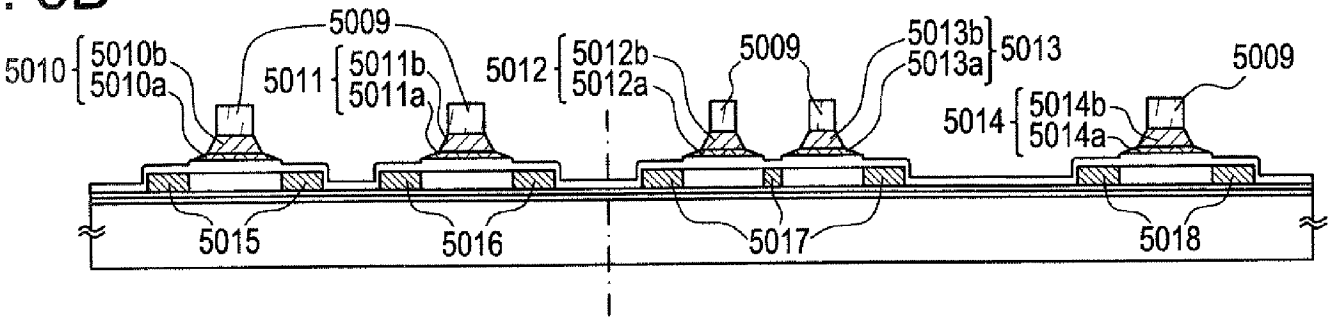

Next, as shown in FIG. 5B, masks 5009 made of resist are formed by using a photolithography method, and a first etching process for forming electrodes and wirings is carried out. In the first etching process, first and second etching conditions are used. In this embodiment, as the first etching condition, an ICP (inductively coupled plasma) etching method is used, in which $CF_4$, $Cl_2$, and $O_2$ are used as etching gases, a gas flow rate is set to 25/25/10 sccm, and an RF (13.56 MHz) power of 500 W is applied to a coil shape electrode under a pressure of 1 Pa to generate plasma. Thus, the etching is performed. A dry etching device using ICP (Model E645-ICP) manufactured by Matsushita Electric Industrial Co. is used here. A 150 W RF (13.56 MHz) power is also applied to the substrate side (sample stage), thereby substantially applying a negative self-bias voltage. The W film is etched under the first etching condition, and the end portion of the first conductive layer is formed into a tapered shape. In the first etching condition, the etching rate for W is 200.39 nm/min, the etching rate for TaN is 80.32 nm/min, and the selectivity of W to TaN is about 2.5. Further, the taper angle of W is about 26° under the first etching condition.

Thereafter, as shown in FIG. 5B, the etching condition is changed into the second etching condition without removing the masks 5009 made of resist, and the etching is performed for about 30 seconds, in which $CF_4$ and $Cl_2$ are used as the etching gases, a gas flow rate is set to 30/30 sccm, and an RF (13.58 MHz) power of 500 W is applied to a coil shape electrode under a pressure of 1 Pa to generate plasma. An RF (13.58 MHz) power of 20 W is also applied to the substrate side (sample stage), and a substantially negative self-bias voltage is applied thereto. In the second etching condition in which $CF_4$ and $Cl_2$ are mixed, the W film and the TaN film are etched to the same degree. In the second etching condition, the etching rate for W is 58.97 nm/min, and the etching rate for TaN is 66.43 nm/min. Note that, in order to perform the etching without leaving any residue on the gate insulating film, it is appropriate that an etching time is increased by approximately 10 to 20%.

In the above first etching process, by making the shapes of the masks formed of resist suitable, end portions of the first conductive layer and the second conductive layer become tapered shape by the effect of the bias voltage applied to the substrate side. The angle of the taper portion may be 15 to 45°.

In this way, first shape conductive layers 5010 to 5014 consisting of the first conductive layer and the second conductive layer (first conductive layers 5010*a* to 5014*a* and second conductive layers 5010*b* to 5014*b*) are formed by the first etching process. Reference numeral 5006 indicates a gate insulating film, and the regions not covered with the first shape conductive layers 5010 to 5014 are made thinner by approximately 20 to 50 nm by etching.

Then, a first doping process is performed to add an impurity element imparting n-type conductivity to the semiconductor layer without removing the masks made of resist (FIG. 5B). Doping may be carried out by an ion doping method or an ion injecting method. The condition of the ion doping method is that a dosage is $1\times10^{13}$ to $5\times10^{15}$ atoms/cm$^2$, and an acceleration voltage is 60 to 100 keV. In this embodiment, the dosage is $1.5\times10^{15}$ atoms/cm$^2$ and the acceleration voltage is 80 key. As the impurity element imparting n-type conductivity, an element belonging to group 15 of the periodic table, typically phosphorus (P) or arsenic (As) is used, but phosphorus (P) is used here. In this case, the conductive layers 5010 to 5014 become masks for the impurity element imparting n-type conductivity, and high concentration impurity regions 5015 to 5018 are formed in a self-aligning manner. The impurity element imparting n-type conductivity in a concentration range of $1\times10^{20}$ to $1\times10^{21}$ atoms/cm$^3$ is added to the high concentration impurity regions 5015 to 5018.

Figure 5C:
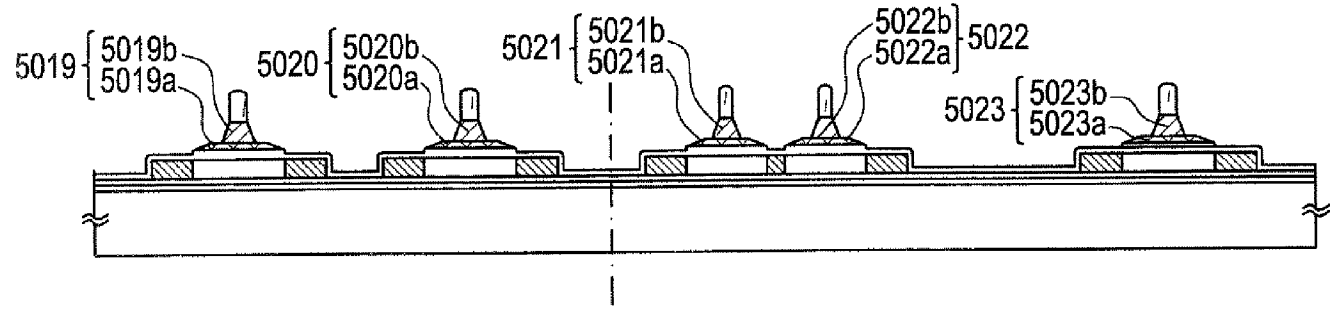

Thereafter, as shown in FIG. 5C, a second etching process is performed without removing the masks made of resist. Here, a gas mixture of $CF_4$, $Cl_2$ and $O_2$ is used as an etching gas, the gas flow rate is set to 20/20/20 sccm, and a 500 W RF (13.56 MHz) power is applied to a coil shape electrode under a pressure of 1 Pa to generate plasma, thereby performing etching. A 20 W RF (13.56 MHz) power is also applied to the substrate side (sample stage), thereby substantially applying a negative self-bias voltage. In the second etching process, the etching rate for W is 124 nm/min, the etching rate for TaN is 20 nm/min, and the selectivity of W to TaN is 6.05. Accordingly, the W film is selectively etched. The taper angle of W is 70° by the second etching process. Second conductive layers 5019*b* to 5023*b* are formed by the second etching process. On the other hand, the first conductive layers 5010*a* to 5014*a* are hardly etched, and first conductive layers 5019*a* to 5023*a* are formed.

Figure 6A:
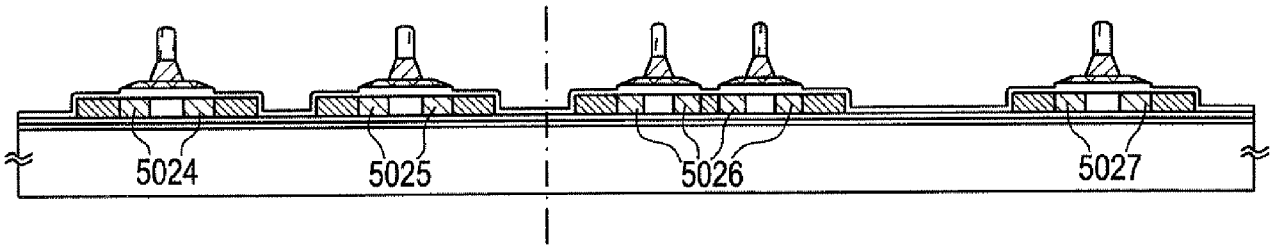
FIGS. 6A to 6C are views to show a manufacturing process example of an active matrix type spontaneous light emitting device.

Next, a second doping process is performed. The second conductive layers 5019*b* to 5023*b* are used as masks for an impurity element, and doping is performed such that the impurity element is added to the semiconductor layer below the tapered portions of the first conductive layers. In this embodiment, phosphorus (P) is used as the impurity element, and plasma doping is performed with a dosage of $1.5\times10^{14}$ atoms/cm$^2$, a current density of 0.5 μA, and an acceleration voltage of 90 keV. Thus, low concentration impurity regions 329 to 333, which overlap with the first conductive layers, are formed in self-aligning manner. The concentration of phosphorus (P) added to the low concentration impurity regions 5024 to 5027 is $1\times10^{17}$ to $5\times10^{18}$ atoms/cm$^3$, and has a gentle concentration gradient in accordance with the film thickness of the tapered portions of the first conductive layers. Note that in the semiconductor layers that overlap with the tapered portions of the first conductive layers, the concentration of the impurity element slightly falls from the end portions of the tapered portions of the first conductive layers toward the inner portions, but the concentration keeps almost the same level. Further, an impurity element is added to the high concentration impurity regions 5015 to 5018. (FIG. 6A)

Figure 6B:
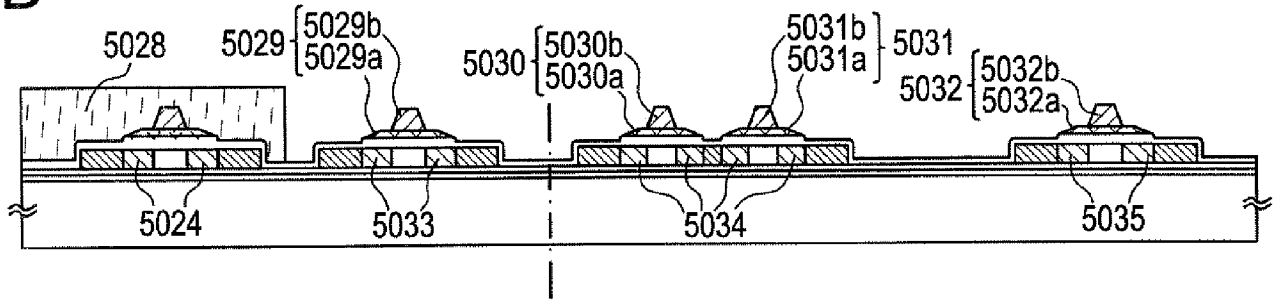
Figure 6C:
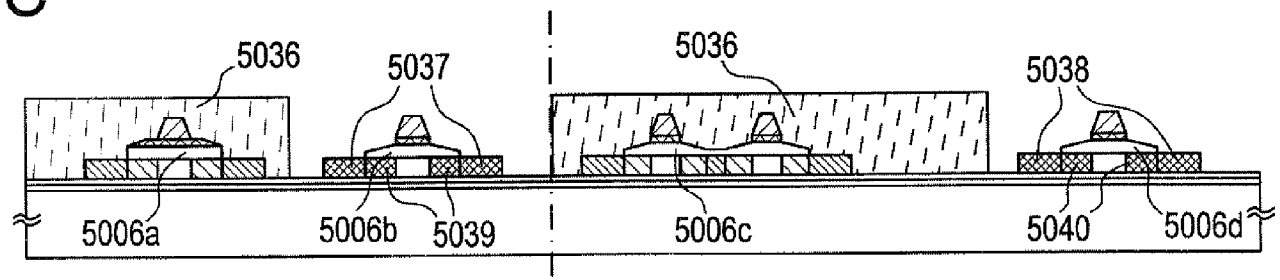

Thereafter, as shown in FIG. 6B, after the masks made of resist are removed, a third etching process is performed using a photolithography method. The tapered portions of the first conductive layers are partially etched so as to have shapes overlapping the second conductive layers in the third etching process. Incidentally mask made of resist are formed in the regions where the third etching process is not conducted.

The etching condition in the third etching process is that $Cl_2$ and $SF_6$ are used as etching gases, the gas flow rate is set to 10/50 sccm, and the ICP etching method is used as in the first and second etching processes. Note that, in the third etching process, the etching rate for TaN is 111.2 nm/min, and the etching rate for the gate insulating film is 12.8 nm/min.

In this embodiment, a 500 W RF (13.56 MHz) power is applied to a coil shape electrode under a pressure of 1.3 Pa to generate plasma, thereby performing etching. A 10 W RF (13.56 MHz) power is also applied to the substrate side (sample stage), thereby substantially applying a negative self-bias voltage. Thus, first conductive layers 5029*a* to 5032*a* are formed.

Impurity regions (LDD regions) 5033 to 5035, which do not overlap with the first conductive layers 5029*a* to 5032*a*, are foamed by the third etching process. Note that impurity region (GOLD regions) 5024 remains overlapping with the first conductive layers 5019*a*.

Further, the electrode constituted of the first conductive layer 5019*a* and the second conductive layer 5019*b* finally becomes the gate electrode of the n-channel TFT of the driver circuit, and the electrode constituted of the first conductive layer 5029*a* and a second conductive layer 5029*b* finally becomes the gate electrode of the p-channel TFT of the driver circuit.

Similarly, the electrode constituted of the first conductive layer 5030*a* to 5031*a* and a second conductive layer 5030*b* to 5031*b* finally becomes the gate electrode of the n-channel TFT of the pixel portion, and the electrode constituted of the first conductive layer 5032*a* and a second conductive layer 5032*b* finally becomes the gate electrode of the p-channel TFT of the pixel portion.

In this way, in this embodiment, the impurity regions (LDD regions) 5033 to 5035 that do not overlap with the first conductive layers 5029*a* to 5032*a* and the impurity regions (GOLD regions) 5024 that overlap with the first conductive layers 5019*a* can be simultaneously formed. Thus, different impurity regions can be formed in accordance with the TFT characteristics.

Next the gate insulating film 5006 is subjected to an etching process, after the masks made of resist are removed. In this etching process, $CHF_3$ is used as an etching gas, and a reactive ion etching method (RIE method) is used. In this embodiment, a third etching process is conducted with a chamber pressure of 6.7 Pa, RF power of 800 W, and a gas flow rate of $CHF_3$ of 35 scorn. Thus, parts of the high concentration impurity regions 5015 to 5018 are exposed, and gate insulating films 5006*a* to 5006*d* are formed.

Subsequently, masks 5036 made of resist is newly formed to thereby perform a third doping process. By this third doping process, impurity regions 5037 to 5040 added with an impurity element imparting conductivity (p-type) opposite to the above conductivity (n-type) are formed in the semiconductor layers that become active layers of the p-channel TFT (FIG. 3C). The first conductive layers 5029*a* and 5032*a* are used as masks for the impurity element, and the impurity element imparting p-type conductivity is added to form the impurity regions in a self-aligning manner.

In this embodiment, the impurity regions 5037 to 5040 are formed by an ion doping method using diborane ($B_2H_6$). Note that, in the third doping process, the semiconductor layers forming the n-channel TFTs are covered with the masks 5036 made of resist. The impurity regions 5037 to 5040 are respectively added with phosphorous at different concentrations by the first doping process and the second doping process. In any of the regions, the doping process is conducted such that the concentration of the impurity element imparting p-type conductivity becomes $2\times10^{20}$ to $2\times10^{21}$ atoms/cm$^3$. Thus, the impurity regions function as source and drain regions of the p-channel TFT, and therefore, no problem occurs.

Through the above-described processes, the impurity regions are formed in the respective semiconductor layers. Note that, in this embodiment, a method of conducting doping of the impurities (boron) after etching the gate insulating film is shown, but doping of the impurities may be conducted before etching the gate insulating film.

Figure 7A:
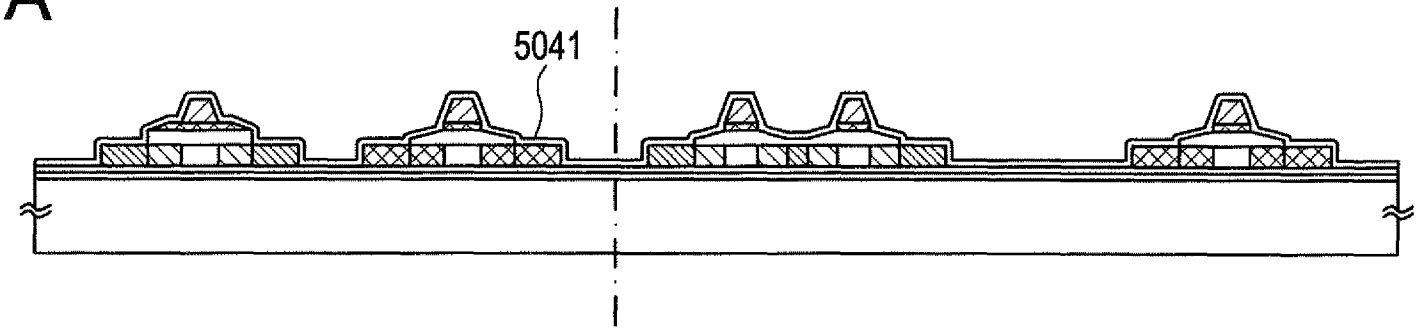
FIGS. 7A and 7B are views to show a manufacturing process example of an active matrix type spontaneous light emitting device.

Subsequently, the masks 5036 made of resist are removed, and as shown in FIG. 7A, a first interlayer insulating film 5041 is formed. As the first interlayer insulating film 5041, an insulating film containing silicon is formed with a thickness of 100 to 200 nm by a plasma CVD method or a sputtering method. In this embodiment, a silicon oxide nitride film of 150 nm thickness is formed by the plasma CVD method. Of course, the first interlayer insulating film 5041 is not limited to the silicon oxide nitride film, and other insulating films containing silicon may be used in a single layer or a lamination structure.

Then, a process of activating the impurity element added to the semiconductor layers is performed. This activation process is performed by a thermal annealing method using an annealing furnace. The thermal annealing method may be performed in a nitrogen atmosphere with an oxygen concentration of 1 ppm or less, preferably 0.1 ppm or less and at 400 to 700° C., typically 500 to 550° C. In this embodiment, the activation process is conducted by a heat treatment for 4 hours at 550° C. Note that, in addition to the thermal annealing method, a laser annealing method or a rapid thermal annealing method (RTA method) can be applied.

Note that, in this embodiment, with the activation process, nickel used as a catalyst in crystallization is gettered to the impurity regions (5015, 5017 and 5037 to 5038) containing phosphorous at high concentration, and the nickel concentration in the semiconductor layer that becomes a channel forming region is mainly reduced. The TFT thus manufactured having the channel forming region has the lowered off current value and good crystallinity to obtain a high electric field effect mobility. Thus, the satisfactory characteristics can be attained.

Further, the activation process may be conducted before the formation of the first interlayer insulating film 5041. Incidentally, in the case where the used wiring material is weak to heat, the activation process is preferably conducted after the formation of the interlayer insulating film 5041 (insulating film containing silicon as its main constituent, for example, silicon nitride film) in order to protect wirings and the like as in this embodiment.

Furthermore, after the activation process and the doping process, the first interlayer insulating film 5041 may be formed.

Moreover, a heat treatment is carried out at 300 to 550° C. for 1 to 12 hours in an atmosphere containing hydrogen of 3 to 100% to perform a process of hydrogenating the semiconductor layers. In this embodiment, the heat treatment is conducted at 410° C. for 1 hour in a nitrogen atmosphere containing hydrogen of approximately 3%. This is a process of terminating dangling bonds in the semiconductor layer by hydrogen included in the interlayer insulating film 5041. As another means for hydrogenation, plasma hydrogenation (using hydrogen excited by plasma) may be performed.

In addition, in the case where the laser annealing method is used as the activation process, after the hydrogenation process, laser light emitted from an excimer laser, a YAG laser or the like is desirably irradiated.

Figure 7B:
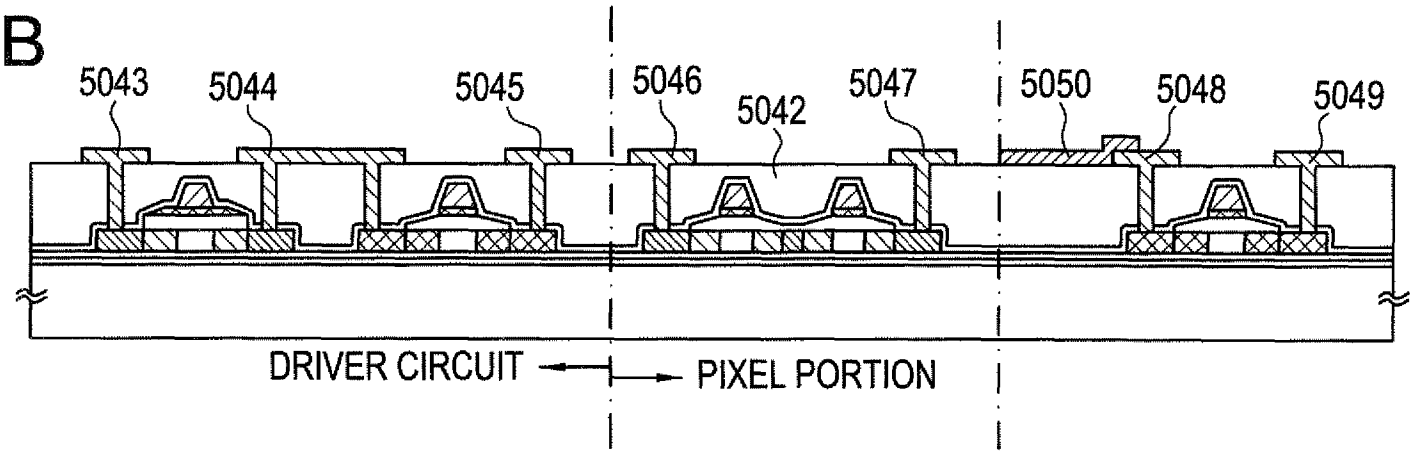

Next, as shown in FIG. 7B, a second interlayer insulating film 5042, which is made from an organic insulating material, is formed on the first interlayer insulating film 5041. In this embodiment, an acrylic resin film is formed with a thickness of 1.6 μm. Then, patterning for forming contact holes that reach the respective impurity regions 5015, 5017 and 5037 to 5038 is conducted.

As the second interlayer film 5042, insulating material containing silicon or organic resin is used. As insulating material containing silicon, silicon oxide, silicon nitride, or silicon oxide nitride may be used. As the organic resin, polyimide, polyimide, acrylic, BCB (benzocyclobutene), or the like may be used.

In this embodiment, the silicon oxide nitride film formed by a plasma CVD method is formed. Note that the thickness of the silicon oxide nitride film is preferably 1 to 5 μm (more preferably 2 to 4 μm). The silicon oxide nitride film has a little amount of moisture contained in the film itself, and thus, is effective in suppressing deterioration of the EL element.

Further, dry etching or wet etching may be used for the formation of the contact holes. However, taking the problem of electrostatic destruction in etching into consideration, the wet etching method is desirably used.

Moreover, in the formation of the contact holes here, the first interlayer insulating film 5041 and the second interlayer insulating film 5042 are etched at the same time. Thus, in consideration for the shape of the contact hole, it is preferable that the material with an etching speed faster than that of the material for forming the first interlayer insulating film 5041 is used for the material for forming the second interlayer insulating film 5042.

Then, wirings 5043 to 5049, which are electrically connected with the impurity regions 5015, 5017 and 5037 to 5038, respectively, are formed. The wirings are formed by patterning a lamination film of a Ti film of 50 nm thickness and an alloy film (alloy film of Al and Ti) of 500 nm thickness, but other conductive films may also be used.

Subsequently, a transparent conductive film is formed thereon with a thickness of 80 to 120 nm, and by patterning the transparent conductive film, a pixel electrode 5050 is formed (FIG. 7B). Note that, in this embodiment, an indium tin oxide (ITO) film or a transparent conductive film in which indium oxide is mixed with zinc oxide (ZnO) of 2 to 20% is used as the pixel electrode 5050.

Further, the pixel electrode 5050 is formed so as to contact and overlap with the drain wiring 5048, thereby having electrical connection with a drain region of a EL driver TFT.

Figure 8:
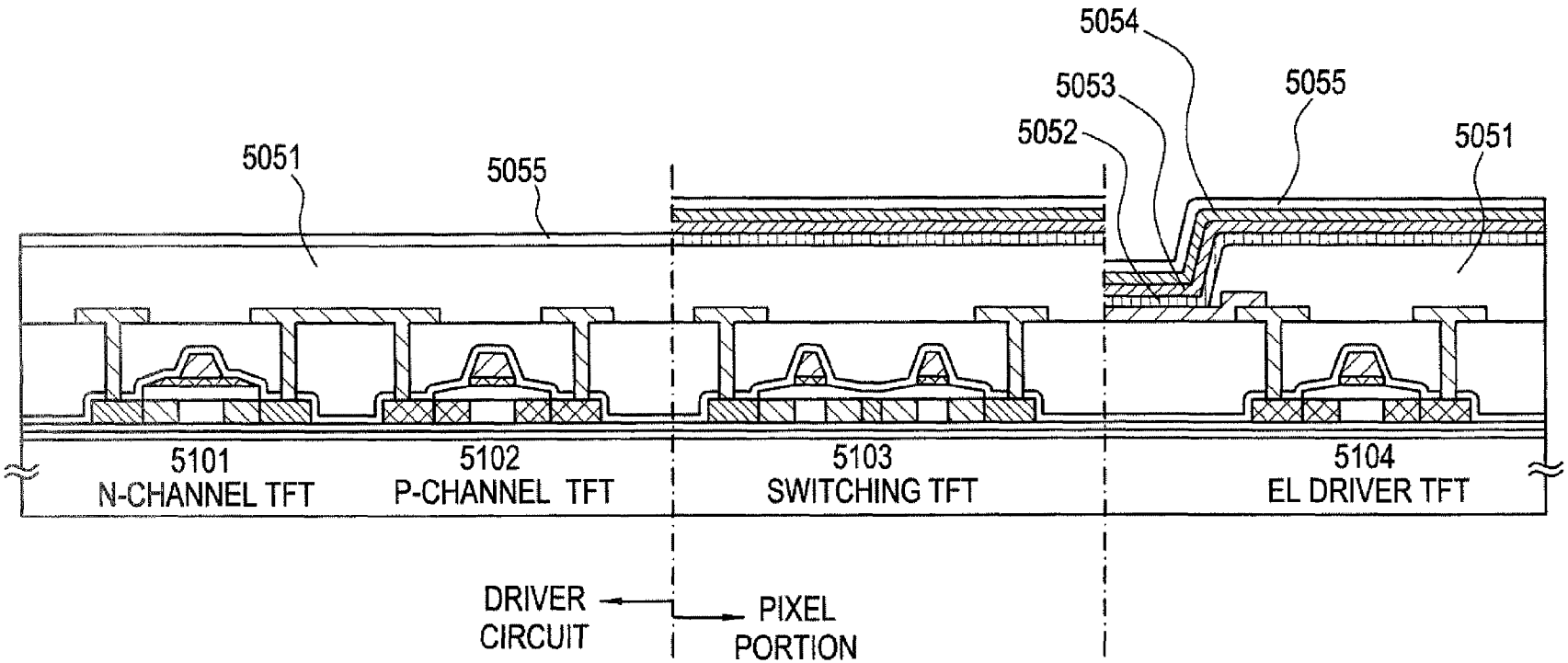
FIG. 8 is a view to show a manufacturing process example of an active matrix type spontaneous light emitting device.
Figure 9A:
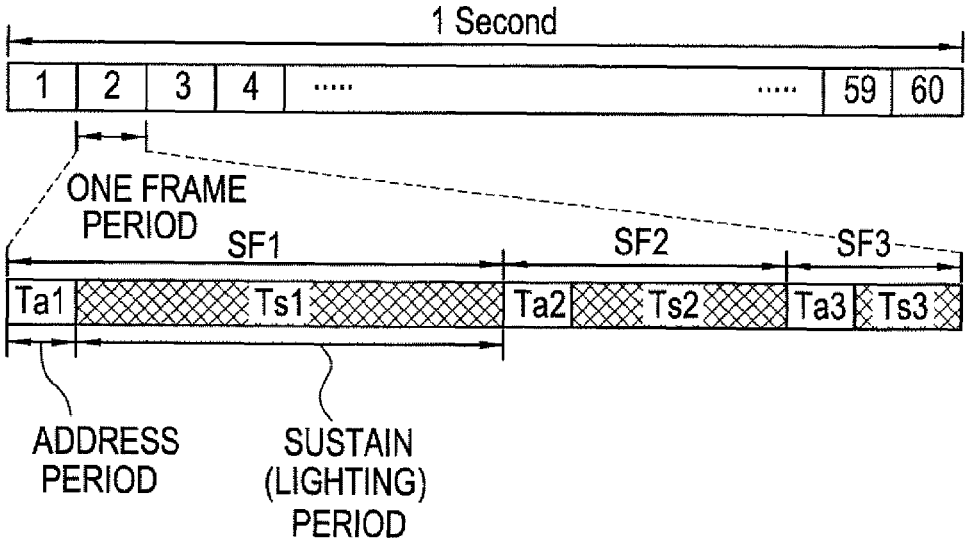
FIGS. 9A and 9B are views to show a time-gradation mode.
Figure 9B:
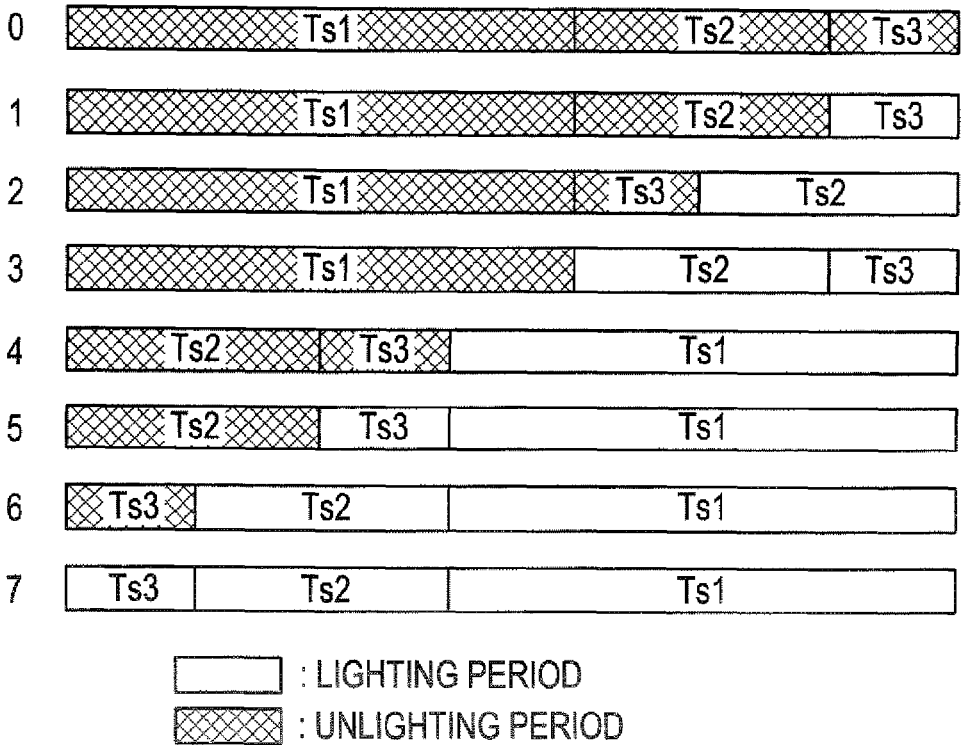
Figure 10A:
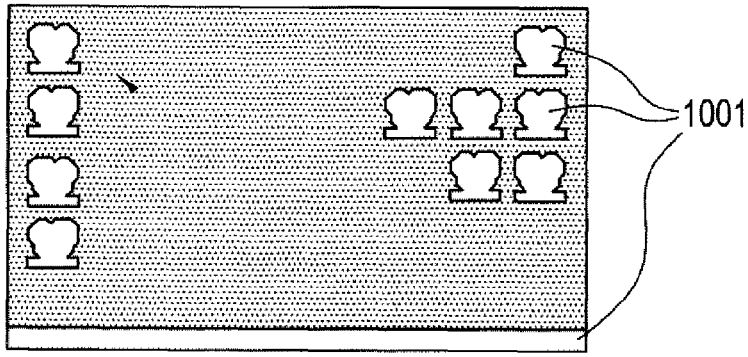
FIGS. 10A to 10C are views to show the occurrence of variations in luminance caused by the degradation of a light emitting element.
Figure 10B:
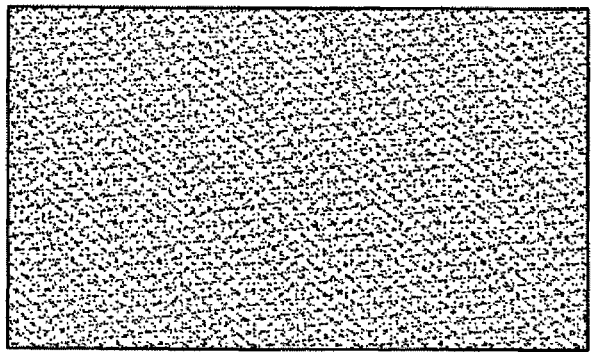
Figure 10C:
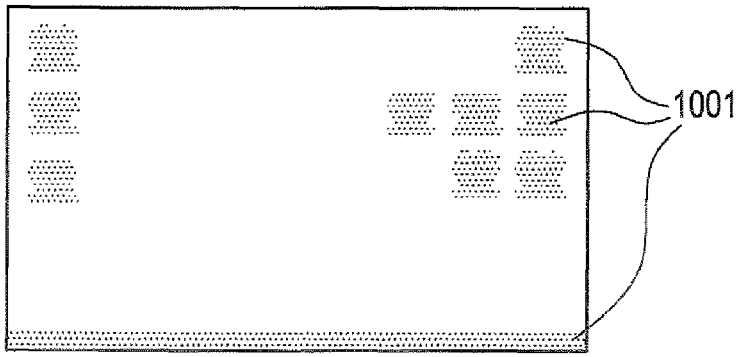

Next, as shown in FIG. 8A, an insulating film containing silicon (a silicon oxide film in this embodiment) is formed with a thickness of 500 nm, and an opening portion is formed at the position corresponding to the transparent electrode 5050 to thereby form a third interlayer insulating film 5051 functioning as a bank. In forming the opening portion, side walls with a tapered shape may easily be formed by using the wet etching method. If the side walls of the opening portion are not sufficiently gentle, the deterioration of the EL layer caused by a step becomes a marked problem. Thus, attention is required.

Note that, in this embodiment, the silicon oxide film is used as the third interlayer insulating film 5051, but depending on the situation, an organic resin film made of polyimide, polyamide, acrylic, or BCB (benzocyclobutene) may also be used.

Next, as shown in FIG. 8A, an EL layer 5052 is formed by an evaporation method, and further, a cathode (MgAg electrode) 5053 and a protective electrode 5054 are formed by the evaporation method. At this time, before the formation of the EL layer 5052 and the cathode 5053, it is desirable that the pixel electrode 5050 is subjected to a heat treatment to completely remove moisture. Note that the MgAg electrode is used as the cathode of the EL element in this embodiment, but other known materials may also be used.

Note that a known material may be used for the EL layer 5052. In this embodiment, the EL layer adopts a two-layer structure constituted of a hole transporting layer and a light emitting layer. However, there may be the case where a hole injecting layer, an electron injecting layer or an electron transporting layer is provided. Various examples of the combination have already been reported, and any structure of those may be used.

In this embodiment, polyphenylene vinylene is formed by the evaporation method as the hole transporting layer. Further, as the light emitting layer, a material in which 1, 3, 4-oxydiazole derivative PBD of 30 to 40% is distributed in polyvinyl carbazole is formed by the evaporation method, and coumarin 6 of approximately 1% is added as a center of green color light emission.

Further, the EL layer 5052 can be protected from moisture or oxygen by the protective electrode 5054, but a passivation film 5055 is preferably formed. In this embodiment, a silicon nitride film of 300 nm thickness is provided as the passivation film 5055. This passivation film may also be formed in succession after the formation of the protective electrode 5054 without exposure to an atmosphere.

Moreover, the protective electrode 5054 is provided to prevent deterioration of the cathode 5053, and is typified by a metal film containing aluminum as its main constituent. Of course, other materials may also be used. Further, the EL layer 5052 and the cathode 5053 are very weak to moisture. Thus, it is preferable that continuous formation is conducted up through the formation of the protective electrode 5054 without exposure to an atmosphere to protect the EL layer 5052 from the outside air.

Note that it is appropriate that the thickness of the EL layer 5052 is 10 to 400 nm (typically 60 to 150 nm) and the thickness of the cathode 5053 is 80 to 200 nm (typically 100 to 150 nm).

Thus, an EL module with the structure shown in FIG. 8A is completed. Note that, in a process of manufacturing an EL module in this embodiment, a source signal line is formed from Ta and W, which are materials forming the gate electrode, and a gate signal line is formed from Al that is a wiring material forming the source and drain electrodes, in connection with the circuit structure and the process. However, different materials may also be used.

Further, a driver circuit having an n-channel TFT 5101 and a p-channel TFT 5102 and a pixel portion having a switching TFT 5103 and a EL driver TFT 5104 can be formed on the same substrate.

Note that, in this embodiment, a structure in which the n-channel TFT is used as the switching TFT 5103 and p-channel TFT is used as the current control TFT 5104, respectively, is shown since the outgoing from a lower surface is adopted in accordance with the structure of the EL element. However, this embodiment is only one preferred embodiment, and the present invention is not necessarily limited to this.

Note that, in this embodiment, although a structure in which the cathode 5053 is formed after the EL layer 5052 is formed on the pixel electrode (anode) 5050, a structure in which the EL layer and the anode are formed on the pixel electrode (cathode) may be adopted. Incidentally, in this case, different from the outgoing from a lower surface described above, the outgoing from an upper surface is adopted. Furthermore, at this time, it is desirable that each of the switching TFT and the EL driver TFT is formed of the n-channel TFT having the low concentration impurity region (LDD region) described in this embodiment.

Embodiment 6

In this embodiment, an external light emitting quantum efficiency can be remarkably improved by using an EL material by which phosphorescence from a triplet exciton can be employed for emitting a light. As a result, the power consumption of the EL element can be reduced, the lifetime of the EL element can be elongated the weight of the EL element can be lightened.

The following is a report where the external light emitting quantum efficiency is improved by using the triplet exciton (T. Tsutsui, C. Adachi, S. Saito, Photochemical process in Organized Molecular Systems, ed. K. Honda, (Elsevier Sci. Pub., Tokyo, 1991) p. 437).

The molecular formula of an EL material (coumarin pigment) reported by the above article is represented as follows.

(Chemical formula 1)

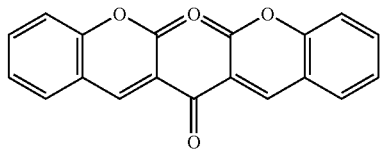

(M. A. Baldo, D. F. O=Brien, Y. You. A Shoustikov, S. Sibley, M. E. Thompson, S. R. Forrest, Nature 395 (1998) p. 151)

The molecular formula of an EL material (Pt complex) reported by the above article is represented as follows.

(Chemical formula 2)

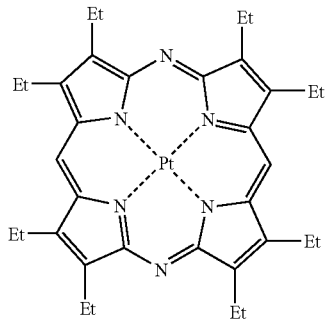

(M. A. Baldo, S. Lamansky, P. E. Burrows, M. E. Thompson, S. R. Forrest, Appl. Phys. Lett., 75 (1999) p. 4.) (T. Tsutsui, M.-J. Yang, M. Yahiro, K. Nakamura, T. Watanabe, T. Tsuji, Y. Fukuda, T. Wakimoto, S. Mayaguchi, Jpn, Appl. Phys., 38 (12B) (1999) L1502)

The molecular formula of an EL material (Ir complex) reported by the above article is represented as follows.

(Chemical formula 3)

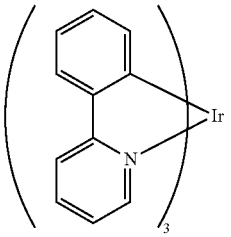

As described above, if phosphorescence from a triplet exciton can be put to practical use, it can realize the external light emitting quantum efficiency three to four times as high as that in the case of using fluorescence from a singlet exciton in principle. The structure according to this embodiment can be freely implemented in combination of any structures of the first to ninth embodiments.

Embodiment 7

The light-emitting display device of the present invention, is a self light emitting type, therefore compared to a liquid crystal display device, it has excellent visible properties and is broad in an angle of visibility. Accordingly, the light-emitting display device can be applied to a display portion in various electronic devices.

The display includes all kinds of displays to be used for displaying information, such as a display for a personal computer, a display for receiving a TV broadcasting program, a display for advertisement display. Moreover, the light-emitting device in accordance with the present invention can be used as a display portion of other various electric devices.

As other electronic equipments of the present invention there are: a video camera; a digital camera; a goggle type display (head mounted display); a car navigation system; en acoustic reproduction device (a car audio stereo, a audio component or the like); a notebook type personal computer; a game apparatus; a portable information terminal (a mobile computer, a portable telephone, a portable game machine, an electronic book or the like); and an image playback device equipped with a recording medium (specifically, device provided with a display portion which plays back images in a recording medium such as a digital versatile disk Player (DVD), and displays the images). In particular, because portable information terminals are often viewed from a diagonal direction, the wideness of the field of vision is regarded as very important. Specific examples of those electronic equipments are shown in FIGS. 11 to 12.

Figure 11A:
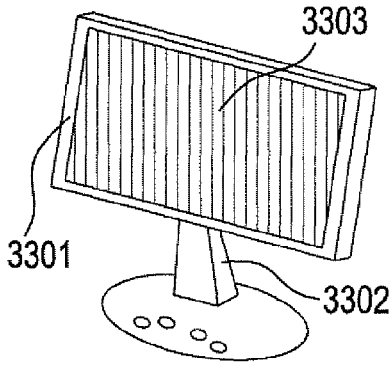
FIGS. 11A to 11F are views to show examples in each of which a spontaneous light emitting device having a degradation correction function in accordance with the present invention is applied to an electronic gear.

FIG. 11A shows an EL display containing a casing 3301, a support stand 3302, and a display portion 3303. The light emitting device of the present invention can be used as the display portion 3303. Such an EL display is a self light emitting type so that a back light is not necessary. Thus, the display portion can be made thinner than that of a liquid crystal display.

Figure 11B:
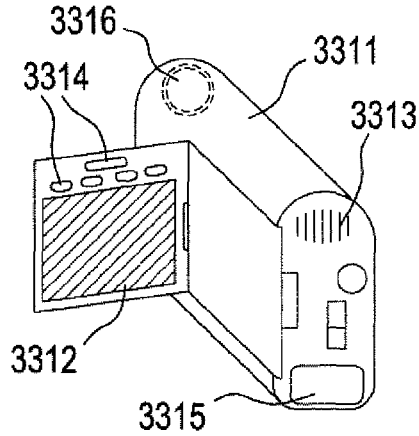

FIG. 11B shows a video camera, and contains a main body 3311, a display portion 3312, a sound input portion 3313, operation switches 3314, a battery 3315, and an image receiving portion 3316. The light emitting device of the present invention can be used as the display portion 3312.

Figure 11C:
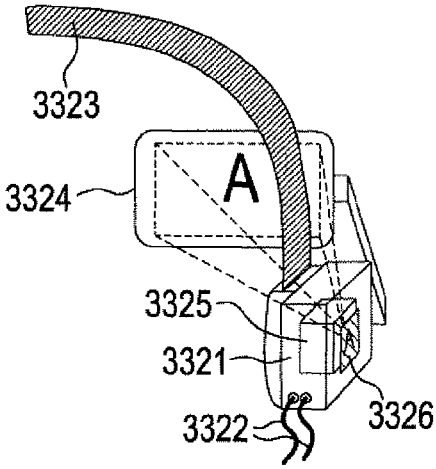

FIG. 11C shows one portion (i.e., a right-hand side) of a head-mounted display including a body 3321, a signal cable 3322, a head fixing band 3323, a display unit 3324, an optical system 3325 and a display portion 3326. The EL display device using a driving method of the present invention can be used the display portion 3326 of the head-mounted display.

Figure 11D:
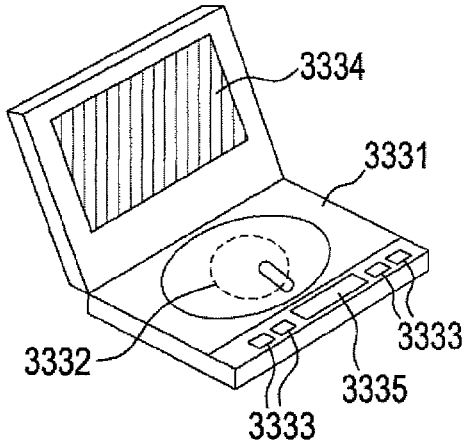

FIG. 11D is an image playback device equipped with a recording medium (specifically, a DVD playback device), and contains a main body 3331, a recording medium (such as a DVD) 3332, operation switches 3333, a display portion (a) 3334, and a display portion (b) 3335. The display portion (a) 3334 is mainly used for displaying image information. The display portion (b) 3335 is mainly used for displaying character information. The light emitting device of the present invention can be used as the display portion (a) 3334 and as the display portion (b) 3335. Note that the image playback device equipped with the recording medium includes game machines or the like.

Figure 11E:
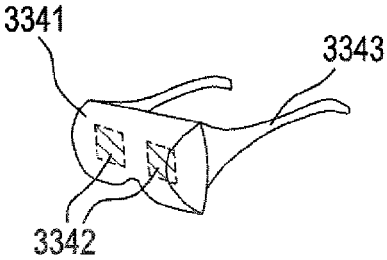

FIG. 11E is a goggle type display (headmounted display), and contains a main body 3341, a display portion 3342 and arm portion 3343. The light emitting device of the present invention can be used as the display portion 3342.

Figure 11F:
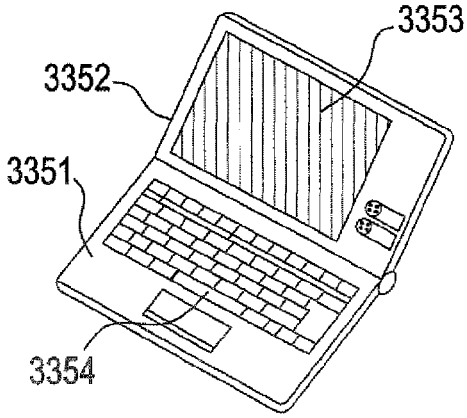

FIG. 11F is a personal computer, and contains a main body 3351, a casing 3352, a display portion 3353, and a keyboard 3354. The light emitting device of the present invention can be used as the display portion 3353.

Note that if the luminance of EL material increases in the future, then it will become possible to use the light emitting device of the present invention in a front type or a rear type projector by expanding and projecting light containing output image information with a lens or the like.

Further, the above electric devices display often information transmitted through an electronic communication circuit such as the Internet and CATV (cable TV), and particularly situations of displaying moving images is increasing. The response speed of EL materials is so high that the above electric devices are good for display of moving image.

In addition, since the light emitting device conserves power in the light emitting portion, it is preferable to display information so as to make the light emitting portion as small as possible. Consequently, when using the light emitting device in a display portion mainly for character information, such as in a portable information terminal, in particular a portable telephone or a sound reproduction device, it is preferable to drive the light emitting device so as to form character information by the light emitting portions while non-light emitting portions are set as background.

Figure 12A:
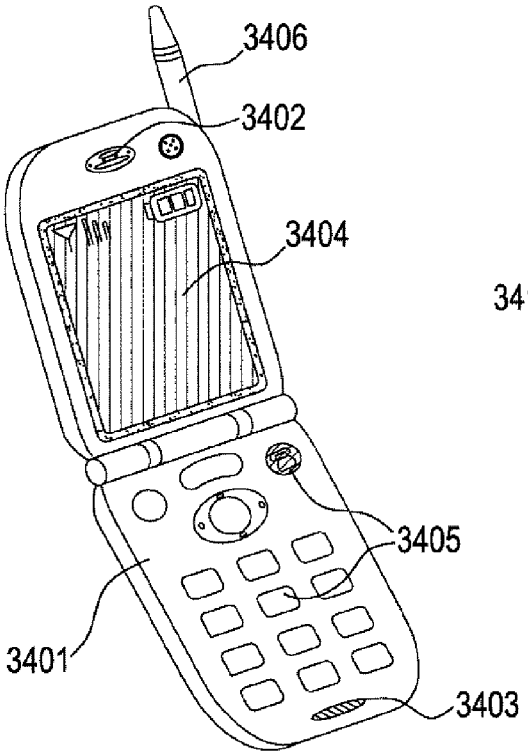
FIGS. 12A to 12C are views to show examples in each of which a spontaneous light emitting device having a degradation correction function in accordance with the present invention is applied to an electronic gear.

FIG. 12A shows a portable telephone, and contains a main body 3401, a sound output portion 3402, a sound input portion 3403, a display portion 3404, operation switches 3405, and an antenna 3406. The light emitting device of the present invention can be used as the display portion 3404. Note that by displaying white color characters in a black color background, the display portion 3404 can suppress the power consumption of the portable telephone.

Figure 12B:
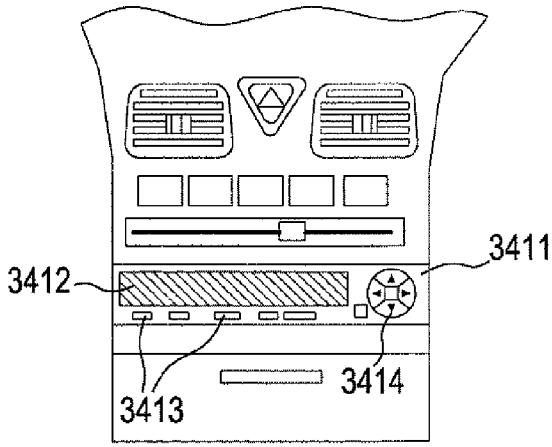

FIG. 12B shows an acoustic reproduction device as exemplified by a car audio stereo, and contains a main body 3411, a display portion 3412, and operation switches 3413 and 3414. The light emitting device of the present invention can be used as the display portion 3412. Further, a car mounting audio stereo is shown in this embodiment, but a portable audio playback device or a fixed type audio playback device may also be used. Note that, by displaying white color characters in a black color background, the display portion 3414 can suppress the power consumption. This is particularly effective in suppressing the power consumption of the portable acoustic reproduction device.

Figure 12C:
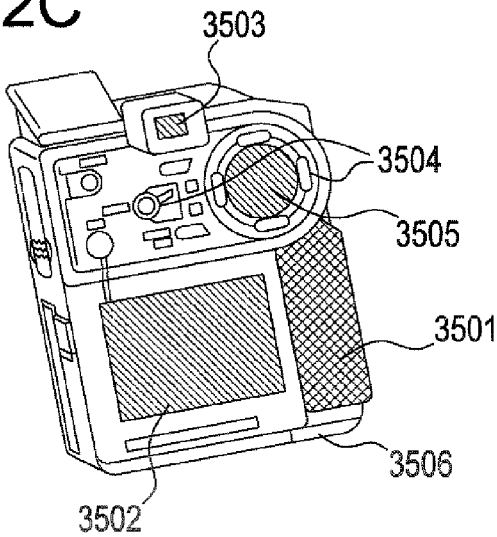

FIG. 12C shows a digital camera, and contains a main body 3501, a display portion A 3502, an eye piece portion 3503, and operation switches 3504, display portion B 3505 and battery 3506. The light emitting device of the present invention can be used as the display portion A 3502 and the display portion B 3505.

As described above, the application range of this invention is extremely wide, and it may be used for electric devices in various fields. Further, the electric device of this embodiment may be obtained by using a light emitting device freely combining the structures of the first to fifth embodiments.

According to the spontaneous light emitting device in accordance with the present invention, it is possible to provide a light emitting device in which the degradation of an EL element caused by a difference in a lighting time is corrected by a circuit to display a uniform screen having no variations in luminance.

What is claimed is:

1. A light emitting device comprising:

a light emitting element comprising a light emitting layer provided between a pair of electrodes and provided over a substrate; and a degradation correction unit comprising a counter unit, a volatile memory, and a nonvolatile memory;

wherein the counter unit detects a lighting time of the light emitting element by sampling first illuminance signals, wherein the volatile memory accumulates the lighting time of the light emitting element, wherein the nonvolatile memory stores an accumulated lighting time of the light emitting element, wherein the first illuminance signals are inputted into the degradation correction unit, and wherein the first illuminance signals are corrected to second illuminance signals in the degradation correction unit according to the accumulated lighting time.

2. A light emitting device according to claim 1, wherein the light emitting layer comprises an EL layer provided between an anode and a cathode which are used as the pair of electrodes.

3. A light emitting device according to claim 1, further comprising a passivation film provided over the light emitting layer.

4. A light emitting device according to claim 1, further comprising a film comprising silicon nitride provided over the light emitting layer.

5. A light emitting device according to claim 2, wherein the EL layer comprises at least one selected from the group consisting of a hole transporting layer, a hole injecting layer, an electron injecting layer and an electron transporting layer.

6. A light emitting device according to claim 1, wherein the degradation correction unit comprises a correction data storage section for storing data of time-varying luminance characteristics of the light emitting element.

7. A light emitting device according to claim 6, wherein the first illuminance signals are corrected to the second illuminance signals in the degradation correction unit according to the accumulated lighting time by referring to the stored data of time-varying luminance characteristics of the light emitting element.

* * * * *

UNITED STATES PATENT AND TRADEMARK OFFICE

CERTIFICATE OF CORRECTION

PATENT NO. : 8,436,792 B2
APPLICATION NO. : 12/722884
DATED : May 7, 2013
INVENTOR(S) : Jun Koyama It is certified that error appears in the above-identified patent and that said Letters Patent is hereby corrected as shown below:

In the Specification:

Column 9, line 58, "101E" should read "101B"

Column 13, line 25, "4118" should read "411B"

Column 15, line 18, "density is et to" should read "density is set to"

Column 15, line 40, "TEDS" should read "TEOS"

Column 16, line 51, "(13.58 MHz)" should read "(13.56 MHz)"

Column 16, line 53, "(13.58 MHz)" should read "(13.56 MHz)"

Column 17, line 17, "80 key." should read "80 keV."

Column 18, line 21, "foamed" should read "formed"

Column 18, line 51, "35 scorn." should read "35 sccm."

Column 20, line 16, "polyimide," should read "polyamide,"

Column 22, line 17, "can be elongated the" should read "can be elongated and the"

Column 22, line 22, "Photochemical process" should read "Photochemical processes"

Column 23, line 40, "navigation system; en" should read "navigation system; an"

Signed and Sealed this
Ninth Day of July, 2013

Teresa Stanek Rea
*Acting Director of the United States Patent and Trademark Office*